US005571590A

United States Patent [19]

Schultz et al.

[11] Patent Number: 5,571,590

[45] Date of Patent: Nov. 5, 1996

[54] METHODS OF MAKING PAPERMAKING FELT AND SUBSTRATE

[75] Inventors: Gary V. Schultz, Kimberly; Dennis J. Le Gault, Appleton, both of Wis.

[73] Assignee: Appleton Mills, Appleton, Wis.

[21] Appl. No.: 469,072

[22] Filed: Jun. 6, 1995

[51] Int. Cl.[6] ..... B32B 3/00

[52] U.S. Cl. ..... 428/57; 139/383 A; 162/900; 162/903; 156/73.2; 156/137; 156/148; 156/217; 156/218; 156/256; 156/264; 156/304.1; 156/304.5; 156/304.6; 156/308.2; 156/309.6; 428/58; 428/61; 428/222; 428/234; 428/300

[58] Field of Search ..... 162/900, 903; 139/383 A; 156/304.5, 304.6, 217, 218, 304.1, 308.2, 309.6, 73.2, 137, 256, 264, 148; 428/57, 58, 61, 222, 234, 300

[56] References Cited

U.S. PATENT DOCUMENTS

| | | | |
|---|---|---|---|
| 2,435,467 | 2/1948 | Spencer | 154/116 |
| 3,109,219 | 11/1963 | De Bell et al. | 28/74 |
| 3,367,810 | 2/1968 | Wasserstein | 156/88 |
| 3,419,447 | 12/1968 | Hewitt | 156/73 |
| 3,486,957 | 12/1969 | Fish et al. | 156/88 |
| 4,534,819 | 8/1985 | Payet et al. | 156/515 |
| 4,737,241 | 4/1988 | Gulya | 162/199 |
| 4,746,546 | 5/1988 | Bachmann et al. | 427/206 |
| 4,761,329 | 8/1988 | Hälker et al. | 428/222 |
| 4,764,417 | 8/1988 | Gulya | 428/222 |
| 5,360,656 | 11/1994 | Rexfelt et al. | 428/193 |
| 5,464,488 | 11/1995 | Servin | 156/73.4 |

FOREIGN PATENT DOCUMENTS 1930556 12/1970 Germany .

*Primary Examiner*—James J. Bell

*Attorney, Agent, or Firm*—Thomas D. Wilhelm; Brian R. Tumm

[57] ABSTRACT

This invention pertains to papermaking felts, methods of making such felts, methods of using the felts, and methods of making paper using such felts. A felt of the invention contains at least one substrate web having a fuse-bonded joint extending across the width of the felt. The joint is preferably formed by superposing, onto each other, end portions of a flat-woven substrate web element, with the end portions extending away from the ends in a common direction, and concurrently severing the ends from the end portions, and fuse bonding the end portions to each other, along a common cut line.

75 Claims, 8 Drawing Sheets

METHODS OF MAKING PAPERMAKING FELT AND SUBSTRATE

FIELD OF THE INVENTION

This invention relates to papermaking, particularly closed loop fabrics used to support and carry cellulosic pulp fibers as they move through the papermaking process. This invention relates specifically to closed loop felts e.g. used in what is known as the press section of the paper machine between the forming fabric and the drying section.

BACKGROUND OF THE INVENTION

In general, a paper machine includes a forming section where a thin slurry of e.g. water and fiber are expressed onto a relatively permeable closed loop forming fabric, also known as a fourdrinier fabric. Free water drains through the forming fabric, leaving a more or less consolidated matt of the fibers on the forming fabric.

From the forming fabric, the consolidated, but still quite wet, matt of fibers is transferred to a papermaking felt. Like the forming fabric, the felt is configured as a closed loop. Typically, the felt carries the consolidated matt of fibers of the web being formed through a press section, where additional water is removed from the matt by mechanically squeezing.

A typical felt comprises a substrate having opposing major surfaces, and one or more batts of fibrous material needled into, or otherwise assembled to, the opposing major surfaces of the substrate. In making the felt, typically the substrate is first woven in a closed loop configuration. More than one substrate web can be used to form the internal structure of the substrate, after which the batts of fibrous material are needled into the substrate from the opposing major surfaces of the substrate.

Depending on the configuration, the composition, and the spacing of the batt fibers, the fibers perform a variety of functions, including influencing the rate of removal of water from the web of paper being formed, and at least influencing the final surface texture of the paper web being formed.

From the felt, the web of paper being formed typically passes into the dryer section of the paper machine, and thence to the winder where the formed and dried web of paper is wound onto a roll.

In any web of paper being formed, the texture and other surface properties, are influenced by texture and other surface properties of the felt. Such surface properties, as well as the interior characteristics such as the overall density and water drainage properties should be uniform. Variations in either the substrate web or the fibers needled into the substrate web are typically reflected in the paper web made with the felt.

Substantial efficiencies are realized as processing speeds are increased in paper making, and in paper converting, processes. In such processes, it is critical that the paper user, or paper converter, be able to rely on uniformity, both along the length and along the width, of the paper web produced at the paper machine.

Accordingly, in making the closed loop felt, the felt should present, to the web being formed into a web of paper, physical properties that are functionally uniform about the entire area of the surface of the felt which contacts the web.

Various methods are known for fabricating the felt as an endless loop. For example, U.S. Pat. No. 4,737,241 Gulya teaches a method using a pin joint to close the loop, across the width of the web, in a previously-formed substrate web having opposing first and second ends. The areas at and immediately adjacent to the pin joint, by their very nature, have structural and thus physical properties that differ somewhat from the properties associated with the remainder of the felt. In all cases, such pin joint felts carry at least the potential that the different properties at the pin joint might be transferred to the paper web manufactured with such felts.

It is known to weave the substrate web for the felt as a closed loop on a shuttle loom appropriately designed for such closed loop weaving. In conventional felts, the closed loop weaving process is often preferred because the felt is fabricated as a closed loop having no ends Such a felt has no joint across its width, and correspondingly no potential for variation of the properties in the felt at the joint.

While a felt fabricated as a closed loop is superior to pin joint felts in that there is no cross-directional joint, weaving a felt substrate web in a closed loop configuration entails significant set-up cost which may be attenuated by weaving a substrate web precursor as a flat fabric, and subsequently forming the flat-woven fabric into an endless loop in a fuse bonding process.

In general, weaving includes a first step of threading an array of warp threads into the weaving machine, followed by the actual thread-by-thread interdigitation of the weft threads into the array of warp threads as the warp threads are advanced past the shuttle or other carrier of weft thread. Compared to flat-woven fabrics, the process of incorporating threads into a fabric being woven in a closed loop configuration is in general slower than flat weaving the same fabric.

Overlooking for the moment the issue of fabricating the substrate web into a closed loop, it is entirely possible for a felt manufacturer to predict with reasonable accuracy the weave patterns and materials of substrate webs which will be needed for manufacturing purposes in the near term future e.g. six months or less. It is much more difficult to predict the length and width requirements of the specific felts which will need to be manufactured in the near term future. Until the length and width requirements of a particular felt are known, it is generally not feasible to begin set-up or weaving of a closed loop substrate web.

Accordingly, the entire process of assembling a felt, including weaving of the substrate web is typically delayed until the manufacturer receives the length and width specifications for the finished felt. As a result, where a pin-joint felt is not acceptable, felt manufacturers are effectively precluded from stockpiling standard woven substrate web materials. They must wait for the customer's specifications and order.

While the felt needed for any given paper machine is typically unique to that machine, most felt substrates incorporate one or more of a relatively small number of weave patterns, using threads according to one or more of a relatively small number of types of materials and/or threads. Thus, in principle, if it were feasible to form the flat-woven substrate web precursor material into a closed loop configuration after manufacture of the substrate web precursor material, the felt manufacturer could reasonably flat weave, and stockpile in e.g. roll form, a variety of the more common substrate web precursor materials in e.g. a relatively small number of weave patterns and materials, against anticipated but not yet received orders.

Such pre-manufacture of the substrate web material would carry attendant cost advantages associated with longer weaving runs without intervening set-up costs, and shorter lead times between receipt of the order and shipment of the finished felt. The felt manufacturer could stockpile a supply of standard substrate webs, and draw appropriate substrate web precursor material from the stockpiled rolls when an order is received.

It is an object of the invention to provide a novel woven felt substrate web, and a felt made therewith, the substrate web having a fuse bonded joint extending across the width of the substrate web, the joint having an outer surface, and texture in the surface, along the width of the web, corresponding with the pattern of the weave.

It is another object of the invention to provide a novel woven felt substrate web, and a felt made therewith, the substrate web having a fuse bonded joint extending across the width of the substrate web, the joint having minimal, if any, residual elements of a crown on one surface of the substrate web, and minimal, if any, residual elements of a valley on the opposing surface.

It is yet another object to provide a novel papermaking felt having a substrate web, and a joint in the substrate web, the machine direction tensile strength generally along the length of the substrate web being relatively greater than the machine direction tensile strength at the joint.

It is still another object to provide a novel papermaking felt, including first and second substrate web elements in face-to-face relation with each other, each having a transverse joint, with the joints spaced from each other.

A further object is to provide a novel method of making a papermaking felt from a flat-woven precursor web, including severing a web element, and forming the web into a closed loop with a fuse bonded joint.

Yet another object is to provide a novel method of making a papermaking felt from a flat-woven precursor web, including severing a web element, superposing end portions of the web element on each other, severing the ends, fuse-bonding the ends to each other, rotating the edge portions about the fuse-bonded ends, and assembling batts of fibrous material to opposing surfaces of the substrate web so formed.

Still another object is to provide a novel method of making a papermaking felt from a flat-woven precursor web, including severing a web element, superposing end portions of the web element on each other, and fuse bonding the ends of the web element to each other.

An additional object is to provide a novel method of making a papermaking felt including fabricating at least first and second substrate web precursors, subsequently specifying the properties of the felt and selecting one of the substrate web precursors, severing a substrate web element from the selected precursor, and forming a fuse-bonded joint in the web precursor to make the closed loop substrate web.

A still additional object is to provide a novel method of making paper, using a felt with a crown, wherein the crown is displaced from the surface which receives the paper web being formed.

Yet a further object is to provide a method of making a papermaking felt including weaving a substrate web precursor on a shuttle-less loom, severing a web element from the precursor, fuse bonding ends of the web element to each other to make the web element into a closed loop configuration comprising the substrate web, and then assembling batts of fibrous material to opposing surfaces of the substrate web.

SUMMARY OF THE DISCLOSURE

Some of the objects are obtained in a first family of embodiments comprehending a substrate web for use in making a papermaking felt, the substrate web circumscribing a closed loop path and having a length along the closed loop path, and a width transverse to the length. The substrate web generally defines first and second opposing surfaces along the length thereof, and comprises woven threads extending along the length and width of the substrate web; and a joint extending in a direction transverse to the length of the substrate web, the joint comprising fused elements of ones of the woven threads, fused to each other at spaced locations along the width of the substrate web, the joint having an curer surface, and texture in the surface, along the width of the substrate web, corresponding with the pattern of the weave.

In typical embodiments, the joint has a first tensile strength along the direction of the length of the substrate web, the substrate web having a second general tensile strength generally distributed along the length thereof at loci displaced from the joint. The second general tensile strength is greater than the first tensile strength, preferably at least 50% greater than the first tensile strength, more preferably at least twice, and up to at least three times as great, as the first tensile strength.

Preferably, the woven threads comprise materials selected from the group consisting of nylon, polyester, and polyurethane. In preferred embodiments, the woven threads comprise a first set of threads extending along the length of the substrate web and a second set of threads extending along the width of the substrate web, the joint comprising fused ends of ones of the threads in the first set.

Preferably, the joint extends across substantially the entirety of the width of the substrate web.

The invention includes a second family of embodiments comprehending a substrate web for use in making a papermaking felt, the substrate web circumscribing a closed loop path and having a length along the closed loop path, and a width transverse to the length. The substrate web generally defines first and second opposing surfaces along the length thereof, and comprises woven threads extending along the length and width of the substrate web; and a joint extending in a direction transverse to the length of the substrate web, the joint comprising a crown on the first surface and a corresponding valley on the second surface.

In typical embodiments, the joint has a first tensile strength along the direction of the length of the substrate web, the substrate web has a general tensile strength generally distributed along its length at loci displaced from the joint. The second general tensile strength is greater than the first tensile strength, preferably at least 50% greater than the first tensile strength, more preferably at least twice as great as the first tensile strength.

Preferably, the woven threads comprise materials selected from the group consisting of nylon, polyester, and polyurethane. In preferred embodiments, the joint comprises fused ends of ones of the woven threads, the fused ends being disposed on ones of the threads which extend along the length of the substrate web, the ends being fused to each other at spaced locations along the joint, the joint having an outer surface, and texture in the surface, along the width of the substrate web, corresponding with the pattern of the weave.

Preferably, the joint extends across substantially the entirety of the width of the substrate web.

The invention includes a third family of embodiments comprehending a papermaking felt circumscribing a closed loop path, the papermaking felt having a first length along the closed loop path and a first width transverse to the first length, a first surface for contacting and carrying a web of paper being formed with the papermaking felt, and a second opposing surface, the papermaking felt comprising a substrate web, having third and fourth opposing surfaces, a second length and a second width, the substrate web having woven threads extending along the second length and the second width of the papermaking felt, and a joint extending transverse to the second length, the joint comprising fused elements of ones of the woven threads, fused to each other along the second width, the joint exhibiting a first tensile strength along the second length, the substrate web having a second general tensile strength generally distributed along the second length at loci displaced from the joint, the second general tensile strength being greater than the first tensile strength; and first and second batts of fibrous material assembled in the papermaking felt on the first and second opposing surfaces.

Preferred embodiments of the papermaking felt are adapted to process substantially any type of paper web without leaving on the paper web any mark, detectable by unaided visual observation, indicating the presence of the joint.

Preferably, the second tensile strength is at least 50% greater than the first tensile strength, more preferably at least twice, and up to at least three mimes as great as the first tensile strength.

In preferred embodiments, the substrate web comprises a first substrate web, the joint comprises a first joint, the papermaking felt including a second substrate web having fifth and sixth opposing surfaces, a third length and a third width, second woven threads extending along the third length and the third width, and a second joint extending transverse to the third length, the second joint exhibiting a third tensile strength along the third length, the second substrate web having a fourth general tensile strength generally distributed along the third length at loci displaced from the second joint, the fourth tensile strength being greater than the third tensile strength, the first and second substrate webs being disposed in face-to-face relationship with each other over substantially the entirety of ones of the surfaces of the respective substrate webs, the first and second joints being spaced from each other. Preferably, the first and second joints are spaced from each other by at least 25% of the first length.

In other ones of this third family of embodiments, the substrate web comprises a first substrate web including the joint, and includes a second endless woven substrate web having fifth and sixth opposing surfaces, the first and second substrate webs being disposed in face-to-face relationship with each other over substantially the entirety of ones of the surfaces of the respective first and second substrate webs.

The woven threads preferably comprise materials selected from the group consisting of nylon, polyester, and polyurethane.

In preferred embodiments of this third family, the respective joints comprise ends of ones of the woven threads fused to each other at locations spaced along the second width of the substrate web, each joint having an outer surface, the respective outer surface having a texture, along the width of the substrate web, corresponding with the pattern of the weave. Each joint typically comprises a crown on the third surface and a corresponding valley on the fourth surface. The first substrate web may be disposed at the first surface, with the first substrate web oriented such that the crown is directed away from the first surface.

In some embodiments, the joint comprises a first joint, the substrate web comprises a first substrate web, and the felt includes a second substrate web having fifth and sixth opposing surfaces, a third length and a third width, the second substrate web having second woven threads extending along the third length and the third width of the second substrate web, and a second joint extending transverse to the third length, the second joint comprising fused elements of ones of the second woven threads, fused to each other along the third width, the second joint comprising a second crown on the fifth surface and a corresponding second valley on the sixth surface. Preferably, the second crown is directed away from the first surface. Also preferably, the joint extends along the entirety of the closed loop path, and across substantially the entirety of the second width of the substrate web.

In a fourth family of embodiments, the invention comprehends a papermaking felt circumscribing a closed loop path, the papermaking felt having a first length along the closed loop path and a first width transverse to the first length, a first surface for contacting and carrying a web of paper being formed with the papermaking felt, and a second opposing surface, the papermaking felt comprising a first substrate web, having third and fourth opposing surfaces, a second length and a second width, the first substrate web having first woven threads extending along the second length and the second width, and a first joint on the first substrate web, extending transverse to the second length, the first joint comprising a first crown on the third surface and a corresponding first valley on the fourth surface; a second substrate web disposed in facing relationship adjacent the first substrate web, and having fifth and sixth opposing surfaces, a third length and a third width, the second substrate web having second woven threads extending along the third length and the third width, and a second joint on the second substrate web, extending transverse to the third length, the second joint comprising a second crown on the fifth surface and a corresponding second valley on the sixth surface; and first and second batts of fibrous material assembled in the papermaking felt on the first and second opposing surfaces.

Preferably, the first substrate web is disposed at the first surface and is oriented such that the first crown is directed away from the first surface.

In some embodiments, the second substrate web is oriented such that the second crown is directed away from the first surface.

In other embodiments, the second substrate web is oriented such that the second crown is directed toward the first substrate web.

The subject papermaking felts containing first and second substrate webs are typically adapted to process substantially any type of paper web without leaving on the paper web any mark, detectable by unaided visual observation, indicating the presence of either of the first and second joints.

Also typically, the first and second joints are spaced from each other by at least 25% of the first length.

Preferably, the first and second woven threads comprise materials selected from the group consisting of nylon, polyester, and polyurethane.

In a fifth family of embodiments, the invention comprehends a method of making a papermaking felt circumscribing a closed loop path, the papermaking felt comprising a substrate web, the papermaking felt having opposing first and second surfaces, and first and second batts of fibrous material assembled to the first and second surfaces, the papermaking felt having a first length along the closed loop path and a first width extending transverse to the length, the substrate web having opposing third and fourth surfaces. The method comprises the steps of fabricating a flat-weave substrate web precursor, the flat-weave substrate web precursor having a second length, preferably at least as great as the first length, and a second width transverse to the second length; severing, from the flat-weave substrate web precursor, a substrate web element having a third length, and a third width transverse to the third length, first and second ends, and corresponding first and second edges; forming the substrate web element into a closed loop path, and thereby fabricating the substrate web, by joining the first and second ends, with at least one fuse-bonded transverse joint extending between the first and second edges in a direction transverse to the length; and securing a batt of fibrous material to at least one of the third and fourth surfaces.

The substrate web may comprise at least two substrate web elements, joined by corresponding at least first and second joints transverse to the third length, the closed loop path extending a distance of at least about 25% of the first length between the first and second joints.

In some embodiments, the method comprises severing first and second substrate web elements from at least one flat weave substrate web precursor, each such substrate web element having first and second ends, forming the substrate web into a closed loop path by joining the first end of the first substrate web element to the second end of the second substrate web element, to form a first joint, by joining the first end of the second substrate web element to the second end of the next substrate web element to form a second joint, and by so joining the first end of each substrate web element to the second end of the succeeding substrate web element, and forming a corresponding joint, with the first end of the last substrate web element being joined to the second end of the first substrate web element.

The method may comprise joining the first and second ends, to form the at least one transverse joint by fuse bonding members of the substrate web element to each other at locations spaced along the third width of the substrate web element, the joint having an outer surface, and texture in the outer surface, along the width of the substrate web, corresponding with the pattern of the weave, each joint preferably describing an angle of at least 45 degrees with an axis extending parallel to the second length.

Preferred methods include joining the first and second ends, to form the at least one transverse joint by superposing first and second end portions of the respective substrate web element adjacent the first and second ends, with the first and second end portions extending away from the respective first and second ends in a common direction, severing the substrate web element through both of the first and second end portions across the third width proximate the first and second ends to form a new first end and a new second end, and fuse bonding the new first end and the new second end to each other to form the joint while the first and second end portions are so superposed with respect to each other, thus forming the substrate web element into the substrate web, rotating the first and second end portions about the fuse-bonded joint such that the first and second end portions extend generally away from each other, with the joint forming a crown on the first surface and a valley on the second surface.

The method preferably includes reducing the prominence of the crown and the prominence of the valley such that paper made with the papermaking felt carries no mark, detectable by unaided visual observation, indicating the presence of the joint. A preferred method of reducing the prominence of the crown and the valley includes needling a batt of fibrous material to at least one of the first and second surfaces subsequent to rotating the first and second end portions about the fuse-bonded joint.

The method preferably includes concurrently severing and fuse bonding the substrate web element at the first and second end portions, proximate the first and second ends, by applying ultrasonic energy to the first and second end portions at a corresponding severing locus, preferably including applying the ultrasonic energy to the substrate web element by advancing the severing locus across the third width.

In a sixth family of embodiments, the invention comprehends a method of making a papermaking felt circumscribing a closed loop path, the papermaking felt comprising a closed loop substrate web, the papermaking felt having opposing first and second surfaces, and first and second batts of fibrous material assembled to the papermaking felt at the first and second surfaces, the papermaking felt having a first length along the closed loop path, and a first width extending transverse to the length, the substrate web having a second length, and a second width transverse to the second length, and opposing third and fourth surfaces, the method comprising the steps of fabricating a substrate web precursor having first and second ends, a third length, and a third width; severing, from the substrate web precursor, a substrate web element having a fourth length, and a fourth width transverse to the fourth length, and third and fourth ends; superposing first and second end portions of the substrate web element adjacent the third and fourth ends, with the third and fourth ends generally aligned with each other and the first and second end portions extending away from the respective third and fourth ends in a common direction; severing the substrate web element across the fourth width proximate the third and fourth ends, thus forming a new third end and a new fourth end, while the first and second end portions are superposed with respect to each other, whereby the respective first and second end portions extend away from the new third end and the new fourth end in the common direction; fuse bonding the new third end and the new fourth end to each other to form a fuse-bonded joint while the first and second end portions are so superposed with respect to each other, thus forming the substrate web element into the closed loop substrate web having a fuse-bonded joint extending across the second width; rotating the first and second end portions about the fuse-bonded joint such that the first and second end portions generally extend away from each other, with the fuse-bonded joint forming a crown on the third surface and a valley on the fourth surface; assembling the first batt of fibrous material to the substrate web at the third surface to make a papermaking felt subassembly, and such that the first batt of fibrous material thereon corresponds with the first surface of the papermaking felt; and assembling the second batt of fibrous material to the subassembly such that the second batt of fibrous material corresponds with the second surface of the papermaking felt.

In preferred embodiments, the assembling of the first and second batts into the papermaking felt subassembly is effective to reduce the prominence of the crown and the prominence of the valley such that a paper made with the closed loop path papermaking felt can be made to carry no mark, detectable by unaided visual observation, indicating the presence of the joint.

The method preferably includes performing the severing and fuse bonding steps concurrent with each other.

In some embodiments, the method comprises joining the new third end and the new fourth end, to form the fuse-bonded joint by fusing members of the substrate web element to each other at locations spaced along the fourth width such that the joint comprises surface texture along the second width.

Preferably, the joint describes an angle of at least 45 degrees with an axis extending parallel to the second length.

In some embodiments, the method includes reducing the prominence of the crown and the prominence of the valley such that paper made with the papermaking felt can be made to carry no mark, detectable by unaided visual observation, indicating the presence of the joint.

Preferred methods include concurrently performing the severing and fuse bonding in steps by applying ultrasonic energy to the first and second end portions at a corresponding severing locus, preferably including applying the ultrasonic energy to the substrate web element by advancing an ultrasonic device across the fourth width.

In a seventh family of embodiments, the invention comprehends a method of making a papermaking felt circumscribing a closed loop path, the papermaking felt comprising a closed loop substrate web, the papermaking felt having opposing first and second surfaces, and first and second batts of fibrous material assembled to the papermaking felt at the first and second surfaces, the papermaking felt having a first length along the closed loop path, and a first width extending transverse to the first length, the substrate web having a second length, and a second width transverse to the second length, and opposing third and fourth surfaces. The method comprises the steps of fabricating a substrate web precursor, having a third length and a third width, and fifth and sixth opposing surfaces, by weaving threads extending along the third length and the third width; severing, from the substrate web precursor, a substrate web element having a fourth length, and a fourth width transverse to the fourth length, and first and second ends and corresponding first and second edges; superposing first and second end portions of the substrate web element adjacent the first and second ends, with the first and second ends generally aligned with each other and the first and second end portions extending away from the respective first and second ends in a common direction; fuse bonding the first and second end portions to each other at the first and second ends, to form a fuse-bonded joint at the first and second ends while the first and second end portions are so superposed with respect to each other, thus forming the substrate web element into the closed loop substrate web having a fuse-bonded joint extending across the substrate web; and assembling fibrous batt material to at least one of the first and second surfaces.

Preferred embodiments include the step, performed simultaneously with the fuse-bonding step, of cutting the substrate web element across the fourth width proximate the first and second ends, thus forming a new first end and a new second end adjacent the respective first and second ends, and thereby making a new cut in the substrate web element in each of the first and second end portions concurrent with fuse bonding the end portions to each other at the new first end and the new second end.

In preferred embodiments, the substrate web element has a fourth length, and a fourth width extending transverse to the fourth length, and the method comprises joining the first and second ends, to form the at least one transverse joint by fuse bonding members of the substrate web element to each other at locations spaced along the fourth width of the substrate web element, the joint having an outer surface, and texture in the outer surface corresponding with the pattern of the weave.

The joint formed by the method preferably describes an angle of at least 45 degrees with an axis extending parallel to the fourth length.

In preferred embodiments, the method includes severing the substrate web element through both of the first and second end portions across the fourth width proximate the first and second ends to form a new first end and a new second end, and fuse bonding the new first end and the new second end to each other to form the fuse-bonded joint, and correspondingly the substrate web, while the first and second end portions are so superposed with respect to each other, rotating the first and second end portions about the fuse bonded joint such that the first and second end portions extend generally away from each other, with the joint forming a crown on the third surface and a valley on the fourth surface. The method preferably includes reducing the prominence of the crown and the prominence of the valley such that paper made with the papermaking felt can be made to carry no mark, detectable by unaided visual observation, indicating the presence of the joint, preferably by needling a batt of fibrous material to at least one of the third and fourth surfaces. The severing to form new first and second ends typically includes severing surplus material from the first and second end portions.

Preferred embodiments include concurrently severing and fuse bonding the substrate web element at the first and second end portions by applying ultrasonic energy to the first and second end portions at a corresponding severing locus, the method including applying the ultrasonic energy to the substrate web element by advancing an ultrasonic device across the fourth width. Preferably, the fuse-bonded joint extends across the entirety of the substrate web, from the first edge to the second edge.

In an eighth family of embodiments, the invention comprehends a method of making a papermaking felt circumscribing a closed loop path, the papermaking felt comprising a closed loop substrate web, the papermaking felt having opposing first and second surfaces, and first and second batts of fibrous material assembled to the papermaking felt at the first and second surfaces, the papermaking felt having a first length along the closed loop path, and a first width transverse to the first length, the substrate web having a second length, and a second width transverse to the second length, and opposing third and fourth surfaces. The method comprises the steps of fabricating first and second flat-woven substrate web precursors having first and second sets of properties, differing from each other, the first substrate web precursor having a third length, and a third width transverse to the third length, the second substrate web precursor having a fourth length, and a fourth width transverse to the fourth length; subsequent to fabricating the first and second flat-woven substrate web precursors, specifying properties of the papermaking felt to be made; selecting, according to the properties specified for the papermaking felt to be made, a preferred one of the first and second flat-woven substrate web precursors, for making the papermaking felt; severing a substrate web element from the selected one of the first and second flat-woven substrate web precursors to appropriate fifth length and fifth width according to the properties specified for the papermaking felt to be made, whereby the substrate web element so made has first and second edges extending along the fifth length, corresponding first and second ends extending across the fifth width, and fifth and sixth opposing surfaces; superposing first and second end portions of the substrate web element adjacent the first and second ends, with the first and second ends generally aligned with each other and the first and second end portions extending away from the respective first and second ends in a common direction; fuse bonding the first and second ends to each other to form a fuse-bonded joint while the first and second end portions are so superposed with respect to each other, thus forming the substrate web element into the closed loop substrate web having the second length and the second width, and the opposing third and fourth surfaces, and a fuse-bonded joint extending across the substrate web between the first and second edges; and assembling a batt of fibrous material to at least one of the third and fourth surfaces.

Preferred embodiments include the step, performed simultaneously with the fuse-bonding step, of cutting the substrate web element across the fifth width proximate the first and second ends, thus forming a new first end and a new second end adjacent the respective first and second ends, and thereby making a new cut in the substrate web element in each of the first and second end portions concurrent with fuse bonding the end portions to each other at the new first end and the new second end.

In preferred embodiments, the method comprises joining the first and second ends, to form the joint by fuse bonding members of the substrate web element to each other at locations spaced along the fifth width of the substrate web element, the joint having an outer surface, and texture in the outer surface corresponding with the pattern of the weave.

The joint formed by the method preferably describes an angle of at least 45 degrees with an axis extending parallel to the second length.

In preferred embodiments, the method includes severing the substrate web element through both of the first and second end portions across the fifth width proximate the first and second ends to form a new first end and a new second end, and fuse bonding the new first end and the new second end to each other to form the fuse-bonded joint, and correspondingly the substrate web, while the first and second end portions are so superposed with respect to each other, rotating the first and second end portions about the fuse-bonded joint such that the first and second end portions extend generally away from each other, with the joint forming a crown on the third surface and a valley on the fourth surface. The method preferably includes reducing the prominence of the crown and the prominence of the valley such that paper made with the papermaking felt can be made to carry no mark, detectable by unaided visual observation, indicating the presence of the joint, preferably by needling a batt of fibrous material to at least one of the third and fourth surfaces. The severing to form new first and second ends typically severs surplus material from the first and second end portions.

In a ninth family of embodiments, the invention comprehends a method of making paper on a continuous-process paper machine, the paper machine including a forming fabric circumscribing a first closed loop path and a papermaking felt circumscribing a second closed loop path, the papermaking felt having a first surface for receiving thereon a web of paper being formed on the paper machine, and an opposing second surface remote from the first surface, the method comprising employing, as the continuous loop felt, a felt having a first length, a first width, and comprising a substrate web and first and second batts of fibrous material assembled to opposing third and fourth surfaces of the substrate web, the third and fourth surfaces of the substrate web generally corresponding to the first and second surfaces of the felt, the substrate web comprising at least one substrate web element having fifth and sixth opposing surfaces and extending about the second closed loop path, the at least one substrate web element comprising a joint extending across the first width, the joint having a crown on the fifth surface and a corresponding valley on the sixth surface, the method including orienting the papermaking felt with respect to the paper machine such that the crown is displaced from the first surface.

Preferably, the fifth surface, and thus the crown, is directed away from the first surface.

Figure 1:
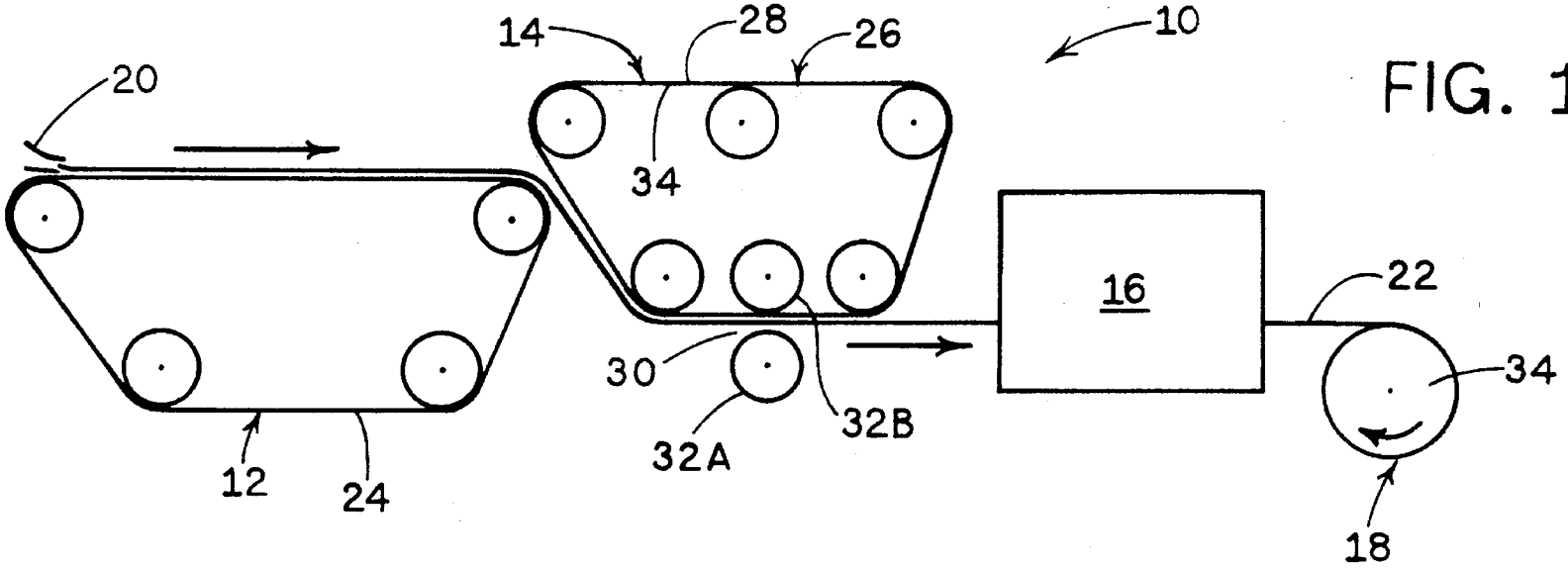
FIG. 1 shows a representative schematic side elevation of a paper machine.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENTS

Referring now by characters of reference to the drawings, and first to FIG. 1, in general, a continuous process paper machine 10 typically includes a forming section 12, a press section 14, a drying section 16, and a wind-up 18. In general, a thin slurry of e.g. water and pulp fibers is expressed from a headbox slice 20 at the forming section 12 onto the closed loop forming fabric 24. Free water is drained from the slurry in the forming section, leaving a wet matt of fibers on the forming fabric. The wet matt of fibers is transferred from the forming fabric to a closed loop papermaking felt 26, and thus transferred to the press section 14.

In the press section, additional water is removed from the wet matt of pulp fibers. In a first mechanism, water is removed from the matt of pulp fibers in the press section by capillary drawing action of fibrous material on the surface 28 of the felt 26, which surface contacts the web of paper being formed, drawing water from the matt of pulp into the interstices of the felt. In a second mechanism, the felt 26, with the now-consolidated, but still wet, web of paper 22 thereon, passes through a nip 30 at a pair of press rolls 32A and 32B, where additional water is forced, by mechanical squeezing, from both the web of paper and the felt.

From the press section, the web of paper is transferred to the dryer 16 where additional water is removed typically by a phase change mechanism, such as by heating the web to thus vaporize water contained therein.

From the dryer, the web of paper 22 is wound up on a wind-up roll 34 in wind-up section 18.

The above is a general description of paper making apparatus and process. Those skilled in the art will recognize that there are many variations on the basic concepts for papermaking described above. The description above should be taken as illustrative only, for use only as an assist in understanding the invention as described more fully hereinafter. Thus, the above description is not limiting as to papermaking apparatus or processes with which the invention disclosed herein may be practiced.

The invention herein addresses the papermaking felt 26, its structure, methods of making the felt, and methods of using the felt.

Figure 2:
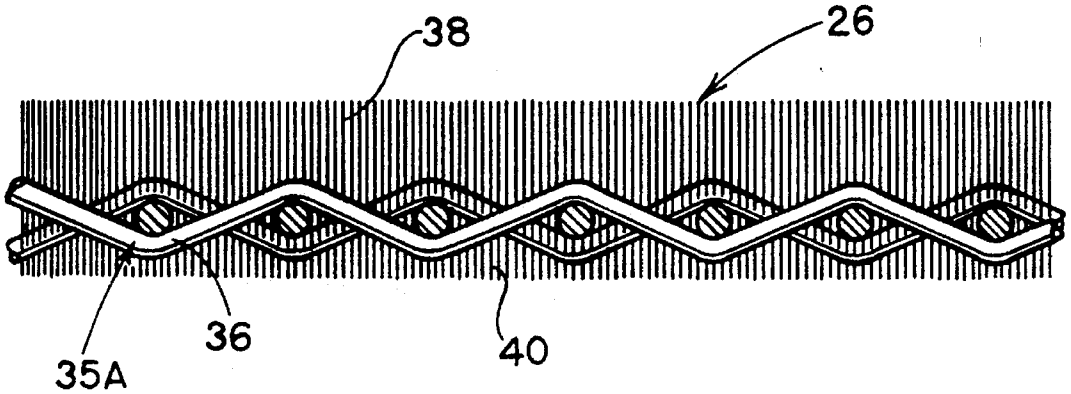
FIG. 2 shows a cross-section of a typical felt having a single-layer substrate web.
Figure 3:
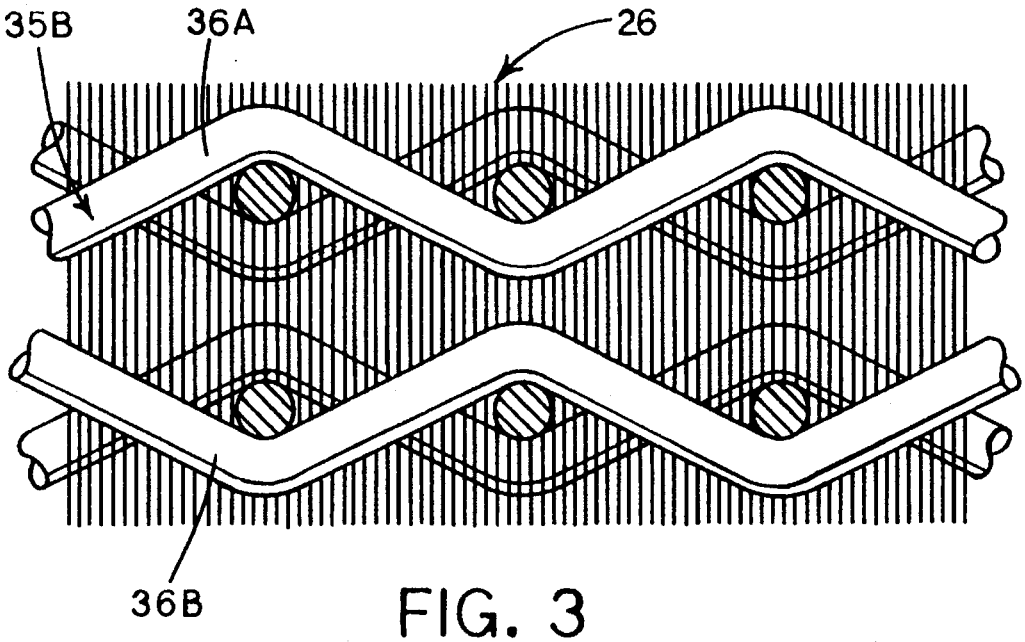
FIG. 3 shows a cross-section of a typical felt having a two-layer substrate web.

FIGS. 2 and 3 show general cross section representations of papermaking felts. In general, a felt 26 embodies a closed loop configuration, as illustrated in FIG. 1. The felt has a length, defined about the closed loop configuration, a width transverse to the length, a first web carrying surface 28 for receiving and carrying the web of paper being formed in the paper machine, and a second roll-side surface 34 opposite the first surface. The felt is constructed of a substrate 35 having at least one substrate web 36, and one or more batts 38, 40 of fibrous material assembled to the substrate on the opposing respective surfaces 28, 34.

FIG. 2 represents a felt having a substrate web 35 comprising a single woven substrate web 36, whereby the substrate 35A comprises a single woven substrate web. FIG. 3 represents a felt having a substrate 35B comprising two woven substrate webs 36A and 36B.

Figure 4:
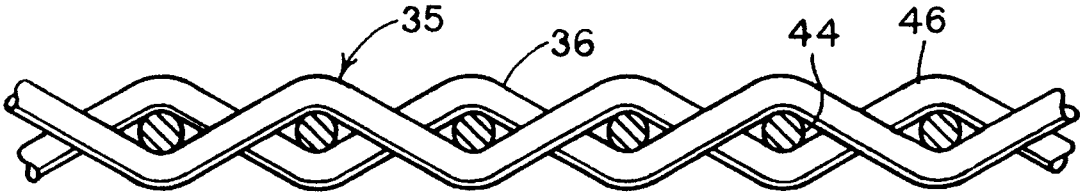
FIG. 4 shows a cross-section of the single-layer substrate web of FIG. 2.

FIG. 4 illustrates a typical woven substrate web used, either alone or in combination with one or more additional substrate webs to form the substrate 35. As seen therein, a substrate web 35 generally comprises a plurality of warp threads 44 woven with weft threads 46.

The invention herein can be practiced with a wide variety of weave patterns, whereby the weave pattern, in general, is of minimal if any significance to the invention.

The invention can be practiced with any known thermoplastic material used to form substrate webs 36. Preferred materials are selected from nylons, polyesters and polyurethanes. The desirability and availability of other thermoplastic materials is known to those skilled in the art, and same are contemplated for use with the invention disclosed here so long as the other properties of the substrate web, not specifically dependent on this invention, are satisfied.

A variety of thread structures are known for use in making substrate webs 36, for example various twisted, braided, etc. thread structures. The invention can be practiced with any of such known thread structures, and related such thread structures developed in the future are contemplated as being useful with the invention herein, whether warp threads or weft threads.

It is common to weave the substrate 35, whether one substrate web 36 or more than one substrate web 36, on a shuttle loom, and to weave the substrate 35 in a continuous weave, closed loop configuration, such that the substrate 35 comprises a closed loop at the time it is removed from the loom.

In the invention herein, a substrate web element precursor 48 is woven in a flat weave configuration, wherein the substrate web element precursor, as woven, has first and second opposing surfaces 49, 51, a length "L1" (not shown), a width "W1," a leading end (not shown), a trailing end 50, and opposing side edges 52, 54. See FIG. 5.

In general, the length of the substrate web element precursor 48 is not directly related to the length of any one felt 26 to be made therefrom. Rather the length of the precursor 48 is controlled by other factors, generally factors related to manufacturing convenience and economy of scale.

Figure 5:
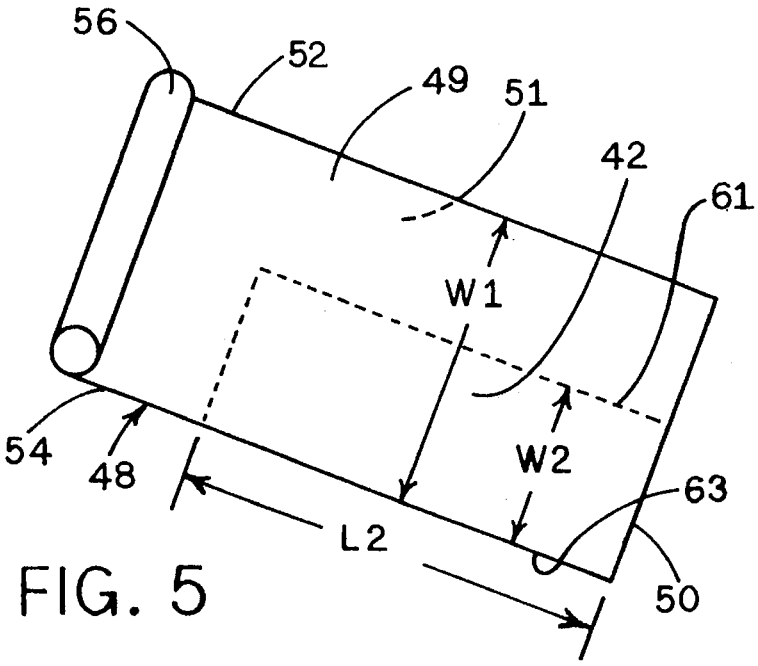
FIG. 5 shows a roll of flat-woven substrate web precursor material of the invention, with a portion unrolled and marked for cutting a substrate web element therefrom.

For example, the length of the precursor 48 may be one which is convenient for collecting and winding up as a roll 56. In FIG. 5, only a portion of the length "L1" is illustrated, the rest being wound up on roll 56. The quantity of the precursor material 48 should be no more than the amount of the precursor material which the felt manufacturer contemplates using economically in a given period of time. However, the quantity should be great enough to allow the manufacturer to achieve economies of scale in the process of actually weaving the precursor material, as related to the associated set-up time required to set-up the weaving process for the specific weave pattern and material to be fabricated.

By using such factors of convenience and economy of scale in determining the length of the substrate web element precursor 48, by weaving the precursor as a flat-woven substrate, and by generally ignoring the length of any specific felt to be made with the precursor material, significant manufacturing economies can be achieved over the conventional practice of endless weaving each substrate 35 to a length directly related to the finished length of a known felt to be made therefrom. In addition, by weaving the substrate web element precursor 48 in a flat-weaving process, the precursor can be made on a shuttle-less loom, whereby the generally higher weaving speed of the shuttleless loom can be achieved. Examples of shuttleless looms are those known as projectile looms, rapier looms, and jet weaving looms.

As a general rule, in this invention, the roll 56 of precursor material 48 is fabricated and stored prior to the time the felt manufacturer receives specifications for a felt to be made therefrom. Rather, the manufacturer can make up a number of such rolls 56 ahead of time, having a variety of sets of properties related to e.g. weave pattern, thread type, and the like. Thus, the felt manufacturer might stock e.g. six different types of flat-woven substrate web precursor materials in roll form. The e.g. six different sets of properties would typically represent the substrate webs most commonly used to make felts according to the invention.

When an order is received for a felt, along with the corresponding specifications, the felt manufacturer's first step in making the felt is to review the existing stock of rolls 56 to see if a stock roll can be used to make the substrate web 36 or, if more than one substrate web is needed in the substrate 35, if a stock roll can be used to make at least one of the substrate webs 36. If so, the trailing end 50 of the respective substrate web element precursor 48 is unrolled from the roll 56, as shown in FIG. 5. Appropriate length "L2" and width "W2" for making the substrate web 36 are determined, and a substrate web element 42, with corresponding length and width, opposing surfaces 61, 63, and side edges, is cut from the substrate web element precursor 48. The extremities of "L2" and "W2" are shown as dotted lines on the woven fabric in FIG. 5. It will be appreciated that the length-to-width ratio of the substrate web element illustrated in FIG. 5 is smaller than the typical length-to-width ratio.

With "L2" and "W2," and the corresponding outline of the substrate web element 42, established, the substrate web element 42 is cut from the substrate web element precursor 48, the remaining length of precursor material 48 is rewound on roll 56, and the roll put back into storage.

Figure 7:
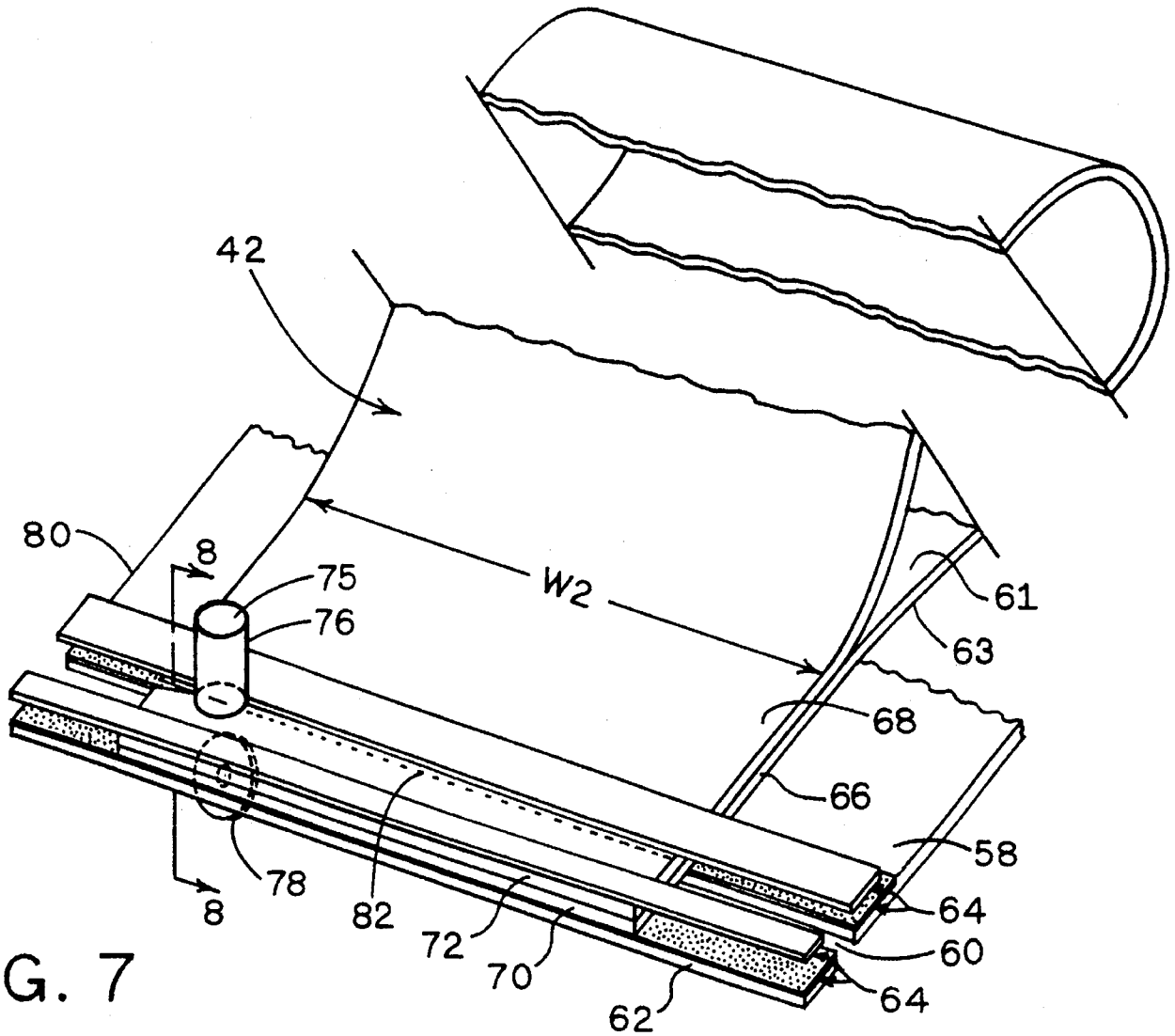
FIG. 7 shows a pictorial view of the apparatus of FIG. 6, with indicators showing advance of the severing and fuse-bonding locus, to form the substrate web element into a closed loop substrate web.
Figure 8:
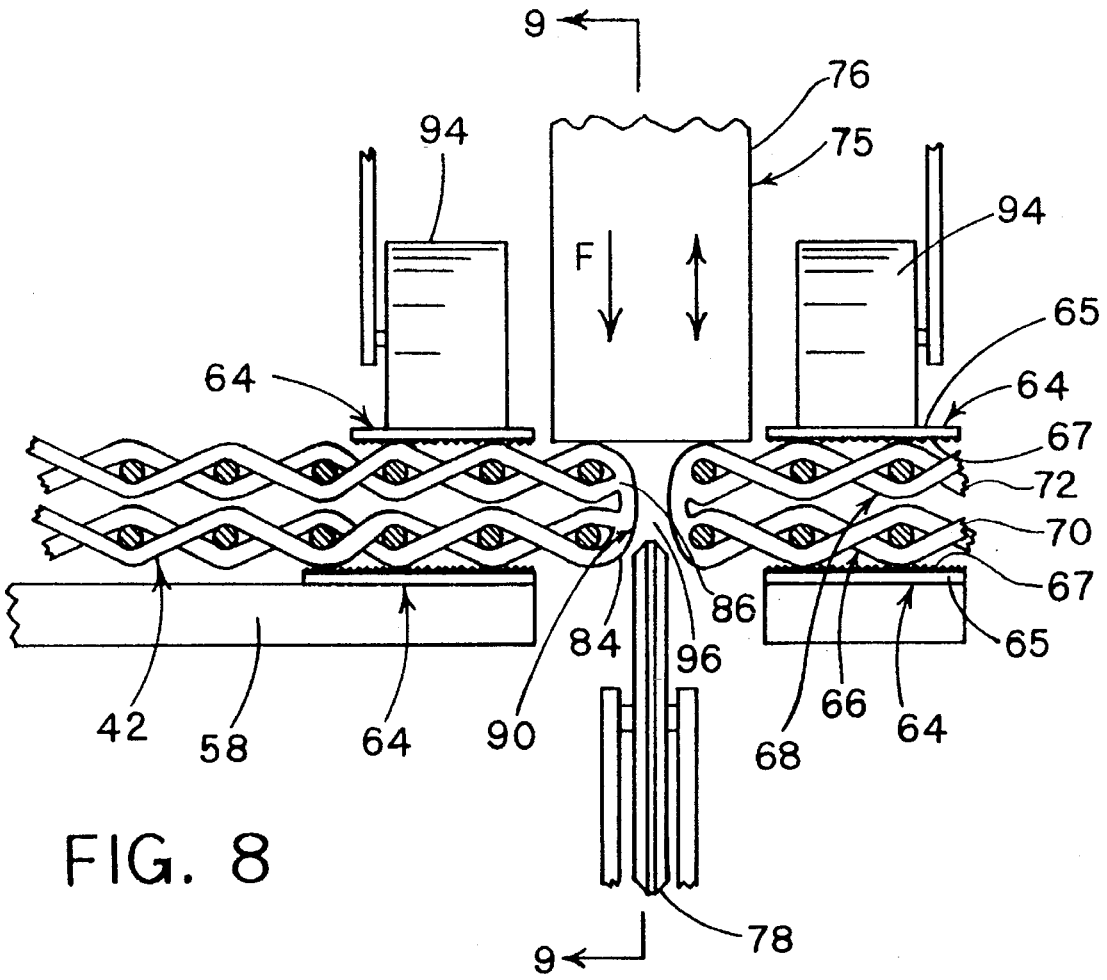
FIG. 8 is an enlarged edge view of a portion of the substrate web of FIG. 7, showing the severed and fuse-bonded joint.

Referring now to FIGS. 7 and 8, a jointing table 58 includes a slot 60 extending along, and inwardly of, one of its edges 62. First and second lower stabilizing strips 64 are secured to the top of the jointing table 58 along the opposing edges of the slot 60. Each lower stabilizing strip 64 includes a relatively thin steel substrate 65, overlain with a sheet of sandpaper 67.

Figure 6:
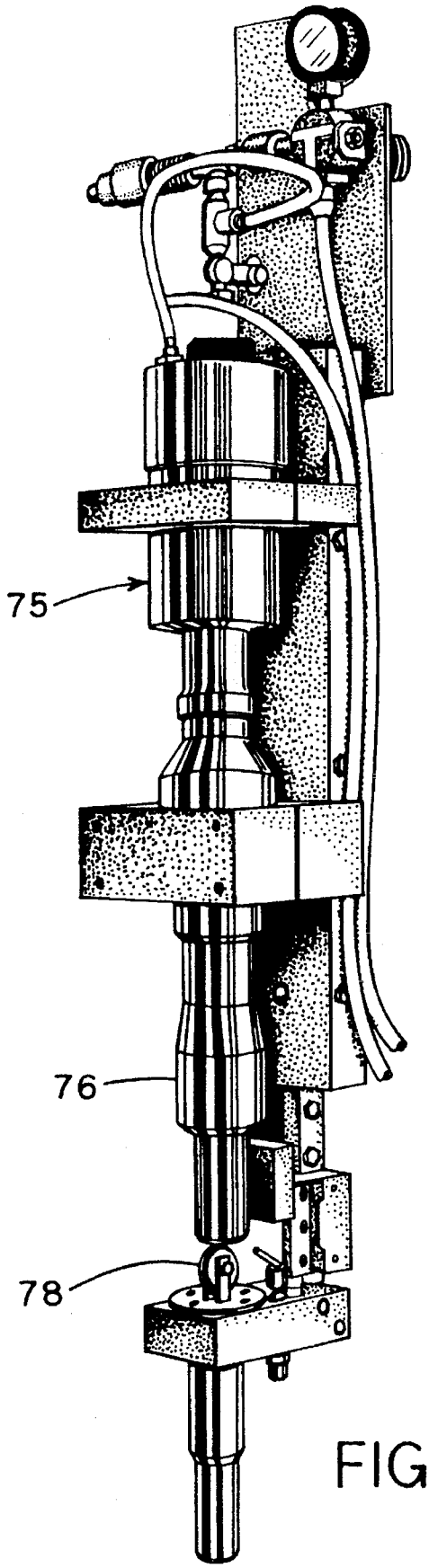
FIG. 6 shows a pictorial side representation of apparatus for severing and fuse-bonding the substrate web element, to make a joint.

A conventional ultrasonic unit 75 is mounted for traversing slot 60, along the edge 62 of the table 58. By structural framework not shown, the ultrasonic unit 75 extends downwardly through slot 60, such that ultrasonic horn 76, and corresponding rotary ultrasonic anvil 78 are disposed at approximately the height of the top of table 58. A preferred rotary anvil 78 has a thickness of about 0.013 inch (33 mm), an included edge angle of 45 degrees to about 90 degrees, and a edge radius at the tip of 0.010 inch (0.25 mm). FIG. 6 illustrates a typical such ultrasonic unit, available from, for example, Branson Company, Danbury, Conn. as Series 900, Model 108, with F-10 slitter assembly. The Branson unit is preferably operated at 20,000 Hertz, with power up to 15 kilowatts. The frequency and power settings, as usual, depend on the specifics of the rest of the operation, and so can be determined in the usual way on an application by application basis.

The structural framework holding the ultrasonic unit is mounted for movement along the edge 62 of the table parallel to slot 60, to thus carry the ultrasonic unit along slot 60 the full width "W2" of the substrate web element 42 while maintaining the horn 76 and anvil 78 at table top height.

With the ultrasonic unit withdrawn to its home position adjacent the edge 80 of the table, and suspended in the slot 60, and with lower stabilizing strips 64 in place as shown in FIGS. 7 and 8, the substrate web element 42 is placed on the jointing table 58 with first and second underlying and overlying end portions 66, 68 respectively, of the element 42, lying on and extending across slot 60, and with the respective first and second ends 70, 72 disposed outwardly of the table 58 from the slot 60, toward edge 62, and generally aligned with each other. In this position, second end portion 68 is superposed over first end portion 66, and the end portions 66, 68 extend away from the ends 70, 72 in a common direction. In this position, shown in FIG. 7, the end portions 66, 68 of the substrate web element represent two thicknesses of the substrate web element overlying the slot 60.

After the end portions 66, 68 have been positioned as shown in FIG. 7, a second pair of stabilizing strips 64 are placed on top of the end portions 66, 68, directly above the stabilizing strips 64 which are on the top of the jointing table 58. The second pair of stabilizing strips 64 are constructed the same as the first pair which is placed on the top of table 58. However, the second pair of stabilizing strips 64 are placed with the sandpaper layer facing downwardly, whereby the sandpaper layers on the upper and lower pairs of stabilizing strips 64 are facing each other, and are in contact with the corresponding upper and lower surfaces of the end portions 66, 68.

The ultrasonic unit is then activated. As the ultrasonic unit is activated, the horn 76 begins oscillating against the rotary anvil 78 as shown by the double-headed arrow in FIG. 8. In addition, a force "F" is imposed urging the horn 76 down toward the rotary anvil 78. Typical such force is about 20 pounds (9 kilograms). In addition, downward force of e.g. about 10 to about 20 pounds (about 4 to about 9 kilograms) is exerted on the second set of stabilizing strips 64 by a pair of pressure rollers 94 on opposing sides of the ultrasonic unit 75. See FIG. 8. The rollers 94 are mounted in common to the structural framework which mounts the ultrasonic unit 75 to the table 58. The rollers 94 thus move along edge 62 and slot 60 along with any movement of the ultrasonic unit 75.

With the ultrasonic unit thus activated, and the substrate web element on the jointing table as shown in FIG. 7, the ultrasonic unit is moved along the slot 60, with the rollers 94 exerting stabilizing downward pressure on the stabilizing strips 64 to thereby stabilize end portions 66, 68 at a travelling locus adjacent the advancing ultrasonic unit 75. The ultrasonic horn and anvil correspondingly act on the two thicknesses of the substrate web element at a locus defined by the combination of the horn 76 and the anvil 78. The downward force on the rollers 94 urges the sandpaper layers on stabilizing strips 64 into intimate contact with the end portions 66, 68, thus stabilizing the end portions 66, 68 on the top of the table while the ultrasonic unit 75 is applying energy along the cut line 82 shown in FIG. 7.

The action of the horn and anvil on the substrate web element generates an advancing locus of localized application of ultrasonic energy to the substrate web element along the cut line 82. See FIG. 7. The localized application of energy by the ultrasonic unit 75 creates thermal energy which severs the first and second ends 70, 72 from the substrate web element 42 along the line 82, simultaneously forming a corresponding new first end 84 and new second end 86. The ultrasonic unit 75 advances the full length of the cut line 82, thus severing the first and second ends 70, 72 from the remainder of the substrate web element at line 82, as surplus material. Once the ends 70, 72 have been completely severed, the ultrasonic unit is preferable retracted to its home position at the edge 74 of table 58.

As the substrate web element 42 is cut along line 82, forming new first end 84 and new second end 86, the localized application of energy also causes limited flow of the fused thermoplastic material among the combination of the warp and weft threads 44, 46 at the advancing severing locus. As the fused thermoplastic material flows, it creates bridges 88 of fused thermoplastic material between and among adjoining ones of the threads 44, 46. The bridges 88 generally extend between and among adjoining threads, including between threads of the upper end portion 68 and the lower end portion 66 as the force in the nip at the horn 76 and anvil 78 urges the end portions 66, 68 toward each other.

Accordingly, as part of the action of the ultrasonic unit 75, the end portions are generally simultaneously urged toward each other by the ultrasonic unit 75, are severed, and are fuse bonded to each other under the modest downward force applied at the ultrasonic horn 76, along line 82. The fuse bonding of the end portions to each other along line 82 generally creates a joint 90 between the overlying end portion 68 and the underlying end portion 66, and extending across the width of the substrate web element at an angle of at least 45 degrees with an axis "X" extending along the length of the substrate web element 42 (See FIG. 12), whereby the substrate web element 42 is transformed into a closed loop configuration, having opposing surfaces 91, 93, and side edges, and is thereafter identified as a substrate web 36.

The fuse bonding preferred in the invention applies a limited amount of energy to the cut line 82 to cut through the end portions 66, 68, and to concurrently fuse together adjoining ones of the threads 44, 46 as the end portions 66, 68 are urged together. The fusing of threads 44, 46 is so limited to the cut line 82 that voids normally existing in the woven substrate web are generally maintained adjacent to the joint. Further, the general weave pattern of the substrate web element 42 is maintained throughout the joint 90, although the voids are somewhat smaller, and at the joint may be filled in, because of the pressure applied while the fuse-bonding and subsequent rapid cooling take place.

The amount of fused material is so limited that there is preferably no general flowing of fused material to generally destroy the weave pattern, and fill all voids and surface texture, at the new ends 84, 86. Rather, the typical joint 90 exhibits the typical surface texture corresponding to the general weave pattern of the substrate web element 42. While the fuse-bonding process preferably does not completely destroy the weave pattern and surface texture, voids 92 may be reduced in size or closed by the fused thermoplastic material which flows during the fuse-bonding process.

The degree to which voids and surface texture are maintained is a function of, among other factors, the amount of energy applied to the ultrasonic unit 75, the pressure applied between the horn and the anvil, the mass of the material being cut at line 82, and the speed of advance of the ultrasonic unit along the line 82. For a typical substrate web element, the Branson ultrasonic unit disclosed above may be advanced at a speed of about 0.5 foot to about 10 feet (about 15 cm to about 305 cm) per minute. A range of about 1 foot to about 2 feet (about 30 cm to about 61 cm) per minute is preferred.

Figure 9:
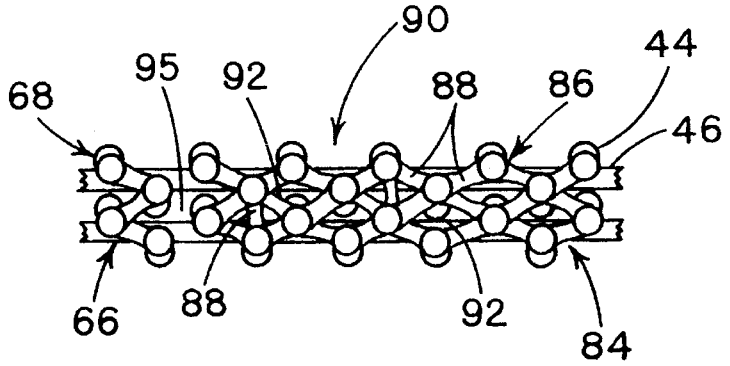
FIG. 9 is an end view of the end portions of the fuse-bonded substrate web of FIG. 7, illustrating texture in the surface of the joint.

FIGS. 8 and 9 illustrate the creation of bridges 88 to effect the fuse-bonding which creates the joint 90. From an edge view of the joint being formed, FIG. 8 illustrates in general the relative locations of the components of the substrate web element 42 being cut and fuse bonded, along with the general positioning of the horn and anvil. A wide gap is shown between the horn and anvil in order to be able to illustrate the threads that are, of course, actually forced together in the nip 96 as the severing locus advances along the cut line 82. FIG. 9 shows a front view of the joint, taken at 9—9 of FIG. 8, thus illustrating exemplary bridging structure between and among the adjacent threads 44, 46, and the corresponding discontinuities across the voids where thermoplastic material did not flow enough to fill the voids in the process of making the joint. The fused material, of course, was subsequently cooled to the solid state after the joint was formed. A further type of discontinuity can occur in the joint wherein a gap 95 may exist across the width of the joint, whereby, at a given point in the width of the substrate web, no fused material connects adjacent threads along the width of the joint. See FIG. 9. The amount of space occupied by voids 92 is exaggerated in FIG. 9 in order that the voids 92 be readily discernible. Further, the number and spacing of bridges in any particular joint, and the actual pattern of bridges at the joint, depend on the conditions used in the fuse-bonding process of making the joint.

While not absolutely critical to the invention, it is preferred that voids 92 be present in the joint, and that the surface texture and weave pattern at and adjacent to the joint reflect the overall weave pattern of the resulting substrate web 36.

A general fusing together of all the thermoplastic material along the line 82 where the joint is created is not desired, and in the preferred embodiments, is not acceptable. However, where the ends 70, 72 are properly aligned with each other, the invention contemplates forming the joint 90 by application of fuse-bonding energy to the ends 70, 72 to form the fuse bonded joint at ends 70, 72 without a corresponding severing of the substrate web element 42. In such situation, cut line 82 is irrelevant, and no cut is formed there.

As the joint is formed by the ultrasonic unit 75, the end portions 66, 68 are in facing relationship with each other, and the joint 90 so formed joins the end portions 66, 68 about a 360 degree directional change in the material as the material traverses the joint. After the ultrasonic unit has been withdrawn to its home position, the end portions 66, 68 overlie each other, with joint 90 therebetween, as seen in dashed outline in FIG. 10.

With the joint so formed, the substrate web is configured as a closed loop, with the formation of the joint being the last step in closing the loop. As the so-formed closed loop substrate web 36 is further processed as a closed loop web, the end portions 66, 68 are inherently rotated generally about the joint 90 to an orientation where the end portions extend away from each other at generally 180 degrees, as shown in solid outline in FIG. 10, in the process of participating in normal loop-type dispositions of the substrate web. Upon such rotation of the end portions 66, 68, the joint 90 tends to maintain the 360 degree configuration at and immediately adjacent the joint, as seen in solid lines in FIG. 10, thus forming a crown 100 on a first surface 102 of the substrate web 36, and a corresponding valley 104 on the opposing second surface 106.

Figure 10:
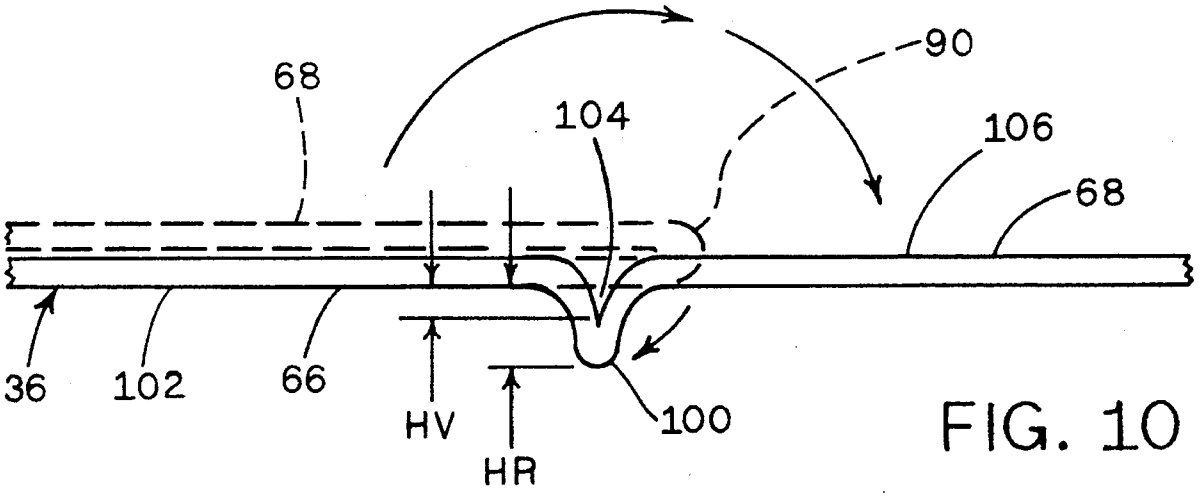
FIG. 10 is a simplified representation of an edge view of the substrate web of FIG. 8, showing rotation of the end portions, and corresponding creation of a crown, and a respective valley, at the joint.
Figure 11:
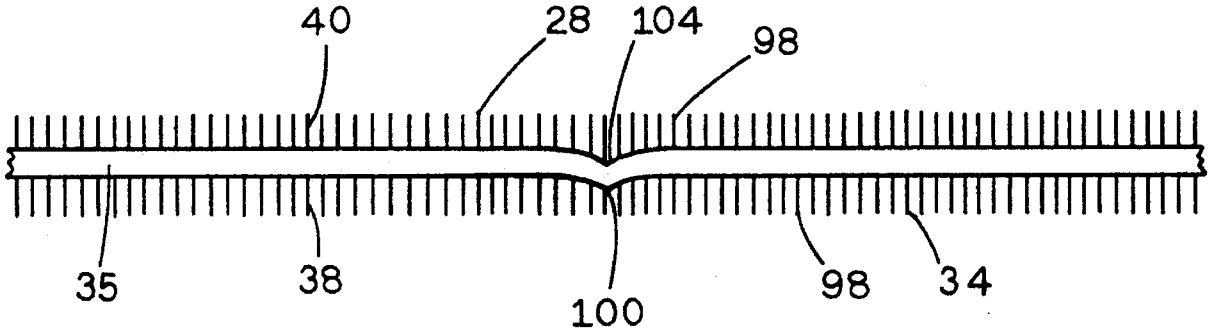
FIG. 11 is a cross-section of a portion of the substrate web of FIG. 10, showing the joint after batts of fibrous material have been needled to the substrate web.

Crown 100 extends from the general plane of first surface 102 by an amount which would leave a lasting impression on any paper web processed with a felt having such a crown. However, applicants have surprisingly discovered that the prominence of the crown 100, and corresponding prominence of valley 104, are greatly attenuated during normal needling of batts 98 of fibrous material, securing the batts to and into the substrate web 36, whereby the crown is substantially flattened during the needling process. In such process, the substrate web 36 is held under tension of e.g. about 3 to about 35 pounds per linear inch (about 3.5 to about 40 kilograms per linear centimeter) across the width of the substrate web. FIG. 11 schematically depicts the reduction in prominence of the crown 100 and valley 104 as a result of the needling process. A comparison of the depictions of the crown 100 and valley 104 in FIGS. 10 and 11 illustrates the degree of reduction in prominence of the crown and valley.

EXAMPLE

A papermaking felt of the invention was made as follows. A substrate web element precursor 42 was woven in a Broken Twill pattern. The machine direction count was 14 threads per inch (5.5 threads per cm). The machine direction (warp) thread was a 6 ply thread. First 2 singles were plied at 10 turns per inch (4 turns per cm) in the "Z" direction, then 3 of such yarns were plied together at 6 turns per inch (2.4 turns per cm) in the "S" direction. The cross machine (weft) thread was a single monofilament at 8 threads per inch (3.1 threads per cm). The substrate web element precursor so woven was 0.037 inch (0.94 mm) thick, and basis weight was 1 ounce per square foot (0.0305 gram per square cm).

Two substrate web elements were cut from the substrate web element precursor so made. Each substrate web element was fuse bonded as discussed above, to make joints 90, crowns 100, and valleys 104, thus making closed loop substrate webs 36A and 36B using the above Branson ultrasonic unit, powered with 15 kilowatts at 20,000 Hertz, advanced along the cut line 82 at a speed of 1 foot (30 cm) per minute. Each substrate web 36 had a tensile strength, along its length, of 30 pounds per linear inch (5.4 kilograms per cm) across the width at joint 90, and a general tensile strength, along its length and away from the joint 90, of 275 pounds per linear inch (49 kilograms per cm).

With the edge portions 66, 68 held away from each other with modest tension as shown in FIG. 10, each crown 100 had a height "HR" of about 4 millimeters. Each valley 104 had a height of "HV" of about 2 millimeters.

Figure 14:
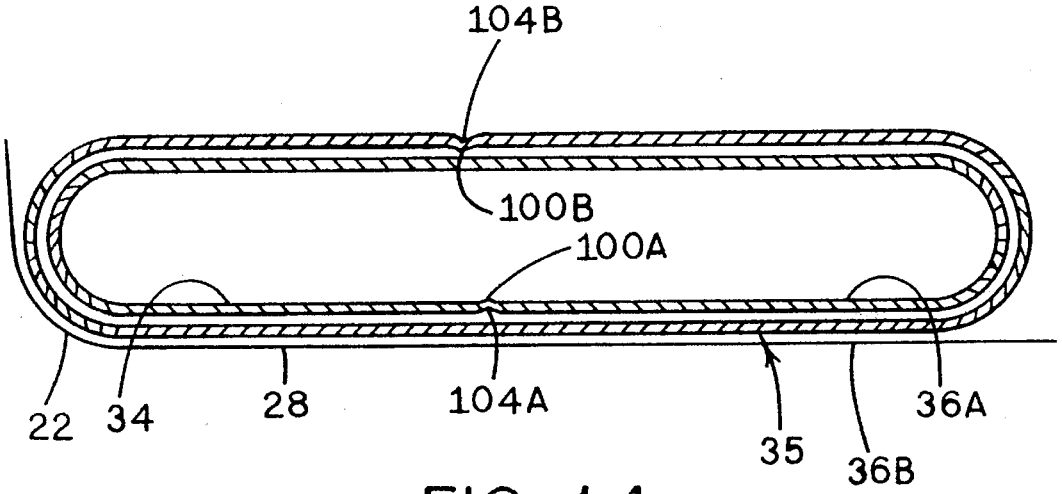
FIGS. 14–16 are schematic representations of felts of the invention, incorporating at least two substrate webs.

The substrate webs were combined in surface-to-surface relationship as shown in FIG. 14, with the crowns 100 facing inwardly in the loop. The closed loop configuration of the two substrate webs, comprising the substrate 35, was then consolidated by needling 2 ounces of nylon fibrous batt material (20 denier threads) into the substrate. Needling was done on a Fehrer Needle Loom, using 2000 needle penetrations per square inch (310 penetrations per square cm), with 8 barb Foster needles.

After needling, the joints were practically impossible to find. The so-needled felt had machine direction tensile strength at the joint of 620 pounds per linear inch width (111 kilograms per linear cm), and machine direction tensile strength outside the joint area of about 1000 pounds per linear inch width (179 kilograms per linear cm).

After the needling operation, the combination of substrate web 36 and batts 98 is herein referred to as a felt, although those skilled in the art recognize that various conventional processing steps remain to be performed before the product is ready for shipment and installation on the paper machine. Once the needling step is completed, a felt made with the fuse-bonded joint 90 of the invention is processed like any conventional felt through the remainder of the normal steps of the felt manufacturing process.

Figure 13:
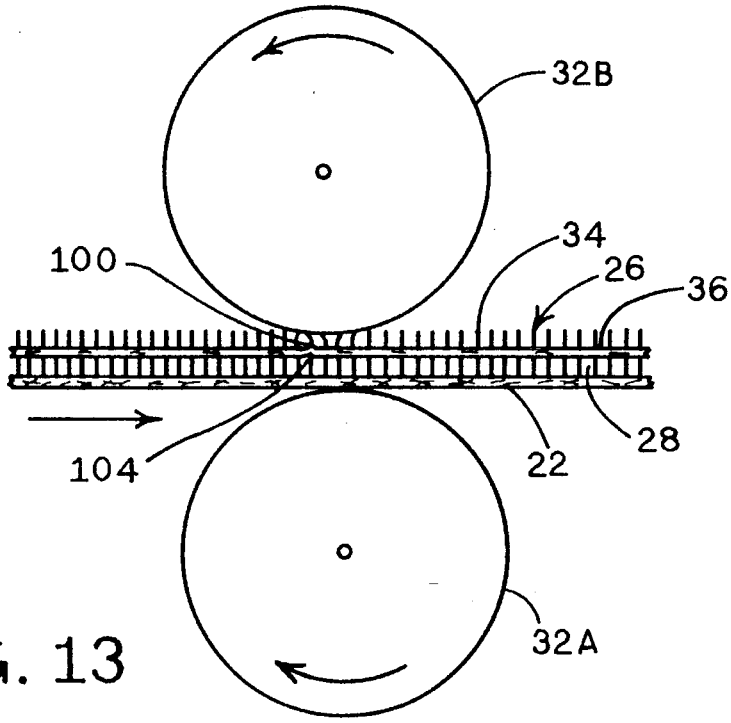
FIG. 13 is an enlarged representation of an elevation view showing a single layer felt of the invention in the press section of a paper machine, with the crown displaced from the surface of the felt which carries the paper web.

In felts made according to the process steps described above with respect to forming the joint 90, and needling the resulting substrate web 36, the joint is virtually impossible to detect, either visually or by inspection of paper made with the felt. According to a preferred embodiment illustrated in FIG. 13, the felt 26 is oriented in the press section such that the crown 100 is displaced from the surface 28 which carries the web of paper 22 being formed. In the embodiment illustrated in FIG. 13, the crown is both (i) displaced from the web of paper 22, by being disposed on the surface of the substrate web 36 which is away from the web 22, and (ii) directed away from the web 22. Accordingly, the crown makes no mark on the web 22 which can be detected by unaided visual observation such as by a microscope or the like. Applicants contemplate that the needling process helps create holes through the substrate web at and adjacent joint 90 to add permeability of the felt to air and water at and adjacent the joint.

General tensile strength of the substrate web 36, generally distributed along the length of the substrate web 36, is greater than the tensile strength at joint 90. Typically the general tensile strength is at least 50% greater than the tensile strength at the joint, and may be twice or three times as great. After completion of the needling and other normal finishing process steps, the resulting felt has a tensile strength generally acceptable for papermaking felt applications. Surprisingly, the lesser tensile strength of the substrate web 36 at joint 90 of the substrate web 36 does not preclude achieving satisfactory tensile strength in the felt as a finished product. Typically the tensile strength at the joint 90 is at least 75% as great as the general tensile strength of the felt at loci remote from the joint.

FIGS. 12 and 14–16 illustrate additional applications of the joint 90 to various substrate web configurations. With respect to FIGS. 12 and 14–16, the discussion which follows assumes that felts made with the substrate webs illustrated therein are mounted with the inside of the loop of the web shown being directed toward the inside of the press loop in the press section.

Figure 12:
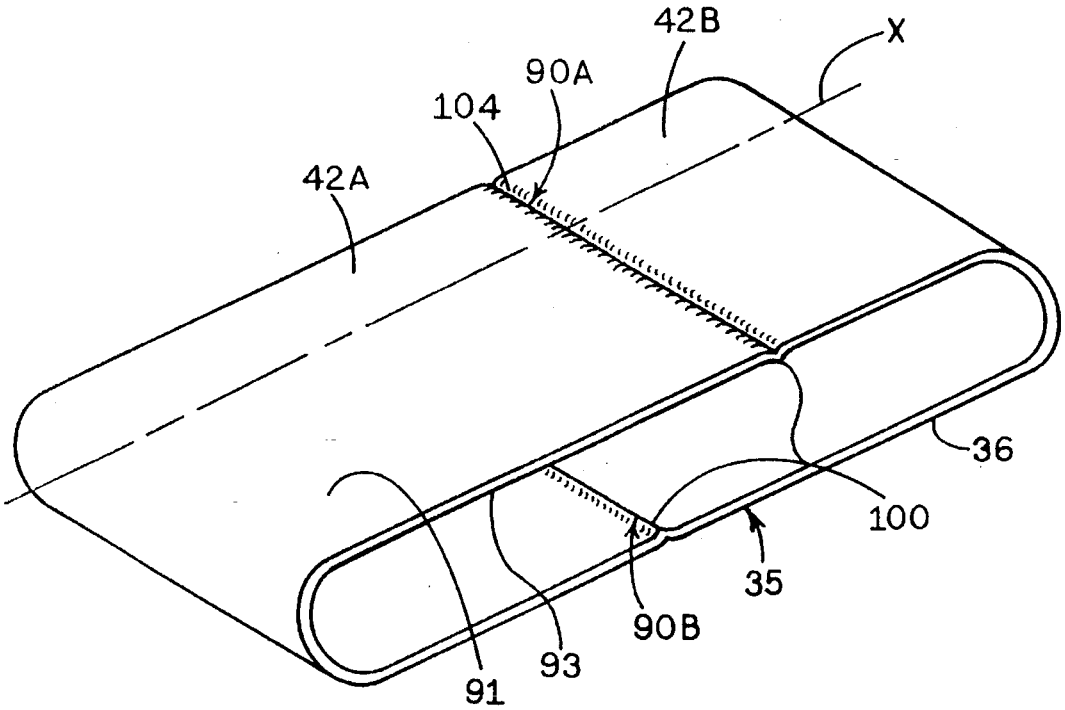
FIG. 12 is a pictorial schematic representation illustrating multiple joints in a substrate web.

FIG. 12 shows a substrate 35 including a single substrate web 36 wherein the substrate web includes first and second joints 90A and 90B, each extending transverse to the length of the substrate web, across the entire width of the substrate web, the joints being spaced from each other along the length of the substrate web—e.g. preferably by at least 25% of the length of the substrate web. The crowns 100 are both displaced from the web of paper 22 and directed away from the web.

The substrate web 36 of FIG. 12 is formed into e.g. a closed-loop configuration by first forming the first joint 90A by joining the first end of the first substrate web element 42A to the second end of the second substrate web element 42B to form joint 90A and by subsequently forming the second joint 90B by joining first end of the second substrate web element 42B to the second end of the substrate web element 42A to form the second joint 90B. Additional substrate web elements 42C, 42D, etc. may be incorporated into the closed loop configuration, with additional corresponding joints, by joining the first end of each substrate web element to the second end of the succeeding substrate web element and forming a corresponding joint.

FIG. 14 illustrates a substrate 35 incorporating first and second inner and outer substrate webs 36A and 36B, respectively. Both webs 36 incorporate crowns 100A and 100B and corresponding valleys 104A, 104B, both of which are displaced from, and directed away from, the web 22.

Figure 15:
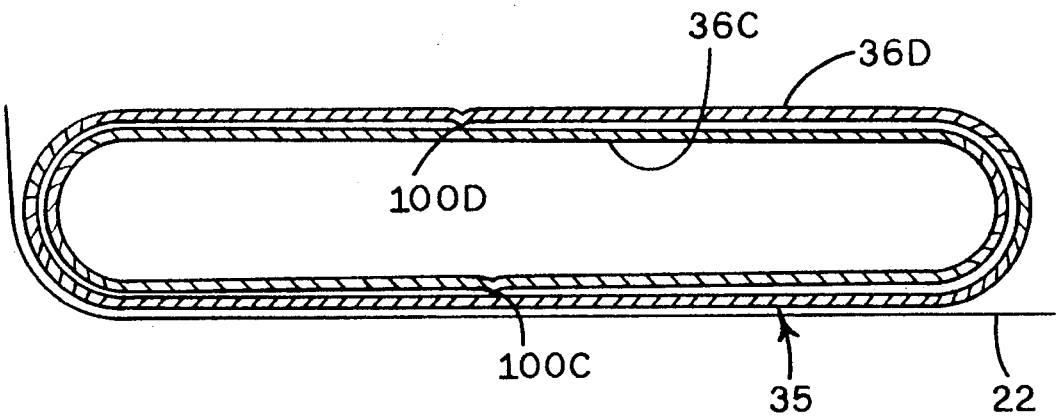

FIG. 15 illustrates a substrate 35 incorporating third and fourth inner and outer substrate webs 36C and 36D, respectively. Inner web 36C incorporates a crown 100C which is directed toward the paper web, but is displaced from the paper web by outer substrate web 36D. Outer web 36D incorporates a crown 100D which is both displaced from, and directed away from, the paper web 22.

Figure 16:
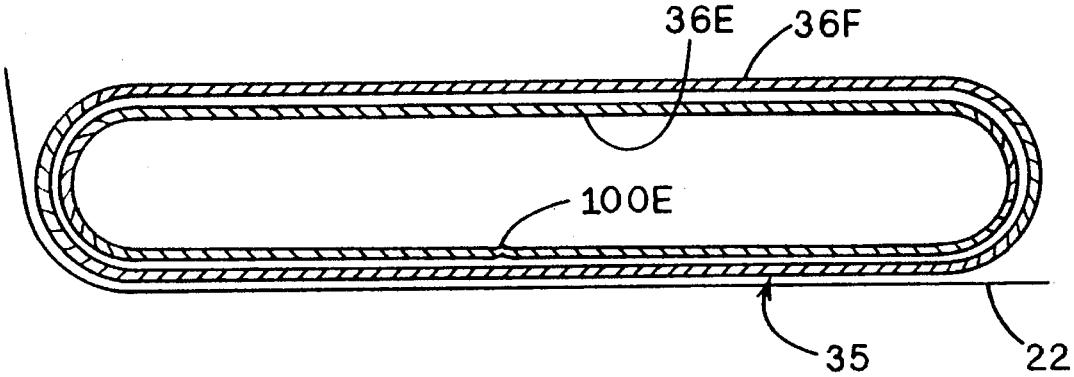

FIG. 16 illustrates a substrate 35 incorporating fifth and sixth inner and outer substrate webs 36E and 36F, respectively. Inner web 36E incorporates a crown 100E which is displaced from the paper web 22 by outer substrate web 36F. Outer web 36F is a web which has been fabricated with a closed loop weaving process, and accordingly has no joint.

The substrate 35 can incorporate any number of substrate webs 36. Any or all of such substrate webs can incorporate therein one or more joints 90. In general, it is preferred that the crown 100 be oriented away from the paper web 22. However, in some cases, the crown 90 can be directed toward the paper web 22 as seen in FIG. 15, and in some cases, may be displaced from the paper web by only the fibers needled into the substrate 35. In general, tensile strength of a second or third, etc. substrate web 36, incorporating a second etc., joint 90 corresponds with the tensile strength considerations given above.

It is contemplated that the operation and functions of the invention have become fully apparent from the foregoing description of elements, but for completeness of disclosure the usage of the invention will be briefly described.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

Having thus described the invention, what is claimed is:

1. A method of making a papermaking felt circumscribing a closed loop path, the papermaking felt comprising a substrate web, the papermaking felt having opposing first and second surfaces, and first and second batts of fibrous material assembled to the first and second surfaces, the papermaking felt having a first length along the closed loop path and a first width extending transverse to the length, the substrate web having opposing third and fourth surfaces, the method comprising the steps of:

(a) fabricating a flat-weave substrate web precursor, the flat-weave substrate web precursor having a second length, a second width transverse to the second length, and a weave pattern;

(b) severing, from the flat-weave substrate web precursor, a substrate web element having a third length, and a third width transverse to the third length, first and second ends, and corresponding first and second edges;

(c) forming the substrate web element into a closed loop, and thereby forming the substrate web element into the substrate web, by joining the first and second ends and forming, in the substrate web element, at least one fuse-bonded joint extending across the substrate web element, and correspondingly across the substrate web, between the first and second edges in a direction transverse to the length; and (d) securing a batt of fibrous material to at least one of the third and fourth surfaces.

2. A method as in claim 1, the substrate web comprising at least two substrate web elements, joined by corresponding at least first and second joints transverse to the third length, the closed loop path extending a distance of at least about 25% of the first length between the first and second joints.

3. A method as in claim 1, the method comprising severing first and second substrate web elements from at least one flat weave substrate web precursor, each such substrate web element having first and second ends, forming the substrate web into a closed loop path by joining the first end of the first substrate web element to the second end of the second substrate web element, to form a first joint, by joining the first end of the second substrate web element to the second end of the next substrate web element to form a second joint, and by so joining the first end of each substrate web element to the second end of the succeeding substrate web element, and forming a corresponding joint, with the first end of the last substrate web element being joined to the second end of the first substrate web element.

4. A method as in claim 1, the method comprising joining the first and second ends, to form the at least one transverse joint by fuse bonding members of the substrate web element to each other at locations spaced along the third width of the substrate web element, the joint having an outer surface, and texture in the outer surface of the joint, along the third width of the substrate web, corresponding with the weave pattern.

5. A method as in claim 1, each joint describing an angle of at least 45 degrees with an axis extending parallel to the second length.

6. A method as in claim 1, including joining the first and second ends, to form the at least one transverse joint by superposing first and second end portions of the substrate web element adjacent the first and second ends, with the first and second end portions extending away from the respective first and second ends in a common direction, severing the substrate web element through both of the first and second end portions across the third width proximate the first and second ends to form a new first end and a new second end, and fuse bonding the new first end and the new second end to each other to form the joint while the first and second end portions are so superposed with respect to each other, thus forming the substrate web element into the substrate web, rotating the first and second end portions about the fuse-bonded joint such that the first and second end portions extend generally away from each other, with the joint forming a crown on the third surface and a valley on the fourth surface.

7. A method as in claim 6 and including reducing the prominence of the crown and the prominence of the valley such that paper made with the papermaking felt carries no mark, detectable by unaided visual observation, indicating the presence of the joint.

8. A method as in claim 7, the method including needling a batt of fibrous material to at least one of the third and fourth surfaces subsequent to rotating the first and second end portions about the fuse-bonded joint.

9. A method as in claim 7, including concurrently severing and fuse bonding the substrate web element at the first and second end portions by applying ultrasonic energy to the first and second end portions at a corresponding severing locus.

10. A method as in claim 9, including applying the ultrasonic energy to the substrate web element by advancing the severing locus across the third width.

11. A papermaking felt made according to a method of claim 1.

12. A papermaking felt made according to a method of claim 2.

13. A papermaking felt made according to a method of claim 3.

14. A papermaking felt made according to a method of claim 6.

15. A papermaking felt made according to a method of claim 7.

16. A papermaking felt made according to a method of claim 8.

17. A papermaking felt made according to a method of claim 10.

18. A method of making a papermaking felt circumscribing a closed loop path, the papermaking felt comprising a substrate web, the papermaking felt having opposing first and second surfaces, and first and second batts of fibrous material assembled to the first and second surfaces, the papermaking felt having a first length along the closed loop path and a first width extending transverse to the length, the substrate web having opposing third and fourth surfaces, the method comprising the steps of:

(a) fabricating a substrate web element, the substrate web element having a second length, a second width transverse to the second length, first and second end portions, and first and second ends;

(b) forming the substrate web element to create a closed loop and thereby form the substrate web element into the substrate web, by forming, in the substrate web element, a fuse bonded joint extending across the substrate web element, and correspondingly across the substrate web, between the first and second edges in a direction transverse to the length; and (c) securing a batt of fibrous material to at least one of the third and fourth surfaces.

19. A method as in claim 18, including limiting the forming of the fuse bonded joint to a single application of fuse-bonding energy across the width of the substrate web element.

20. A method as in claim 18, fabricating the substrate web element comprising weaving the substrate web such that the third and fourth surfaces comprise weave patterns, the method comprising joining the first and second ends, to form the joint, by fuse bonding members of the substrate web element to each other at locations spaced along the second width of the substrate web element, the joint having an outer surface, and texture in the outer surface of the joint, along the second width of the substrate web, reflecting the weave pattern of the corresponding one of the third and fourth surfaces.

21. A method as in claim 18, including joining the first and second ends, to form the joint by superposing the first and second end portions, with the first and second end portions extending away from the respective first and second ends in a common direction, severing the substrate web element through both of the first and second end portions across the second width proximate the first and second ends to form a new first end and a new second end, and fuse bonding the new first end and the new second end to each other to form the joint while the first and second end portions are so superposed with respect to each other, thus forming the substrate web element into the substrate web, rotating the first and second end portions about the fuse-bonded joint such that the first and second end portions extend generally away from each other, with the joint forming a crown on the third surface and a valley on the fourth surface.

22. A method as in claim 21 and including reducing the prominence of the crown and the prominence of the valley such that paper made with the papermaking felt so made carries no mark, detectable by unaided visual observation, indicating the presence of the joint.

23. A method as in claim 22, the method including needling a batt of fibrous material to at least one of the third and fourth surfaces subsequent to rotating the first and second end portions about the fuse-bonded joint.

24. A method as in claim 22, including concurrently severing and fuse bonding the substrate web element at the first and second end portions by applying ultrasonic energy to the first and second end portions at a corresponding severing locus.

25. A method as in claim 24, including applying the ultrasonic energy to the substrate web element by advancing the severing locus across the second width.

26. A papermaking felt made according to a method of claim 18.

27. A papermaking felt made according to a method of claim 19.

28. A papermaking felt made according to a method of claim 21.

29. A papermaking felt made according to a method of claim 22.

30. A papermaking felt made according to a method of claim 23.

31. A papermaking felt made according to a method of claim 25.

32. A method of making a papermaking felt circumscribing a closed loop path, the papermaking felt comprising a closed loop substrate web, the papermaking felt having opposing first and second surfaces, and first and second batts of fibrous material assembled to the papermaking felt at the first and second surfaces, the papermaking felt having a first length along the closed loop path, and a first width extending transverse to the length, the substrate web having a second length, and a second width transverse to the second length, and opposing third and fourth surfaces, the method comprising the steps of:

(a) fabricating a substrate web precursor having first and second ends, a third length, a third width and a weave pattern;

(b) severing, from the substrate web precursor, a substrate web element having a fourth length, and a fourth width transverse to the fourth length, and third and fourth ends;

(c) superposing first and second end portions of the substrate web element adjacent the third and fourth ends, with the third and fourth ends generally aligned with each other and the first and second end portions extending away from the respective third and fourth ends in a common direction;

(d) severing the substrate web element across the fourth width proximate the third and fourth ends, thus forming a new third end and a new fourth end, while the first and second end portions are superposed with respect to each other, whereby the respective first and second end portions extend away from the new third end and the new fourth end in the common direction;

(e) fuse bonding the new third end and the new fourth end to each other to form a fuse-bonded joint while the first and second end portions are so superposed with respect to each other, thus forming the substrate web element into the closed loop substrate web having a fuse-bonded joint extending across the second width;

(f) rotating the first and second end portions about the fuse-bonded joint such that the first and second end portions generally extend away from each other, with the fuse-bonded joint forming a crown on the third surface and a valley on the fourth surface;

(g) assembling the first batt of fibrous material to the substrate web at the third surface to make a papermaking felt subassembly, and such that the first batt of fibrous material thereon corresponds with the first surface of the papermaking felt; and (h) assembling the second batt of fibrous material to the subassembly such that the second batt of fibrous material corresponds with the second surface of the papermaking felt.

33. A method as in claim 32, the assembling of the first and second batts into the papermaking felt subassembly being effective to reduce the prominence of the crown and the prominence of the valley such that a paper made with the closed loop path papermaking felt can be made to carry no mark, detectable by unaided visual observation, indicating the presence of the joint.

34. A method as in claim 32, including performing the severing and fuse bonding steps (d) and (e) concurrent with each other.

35. A method as in claim 32, the method comprising joining the new third end and the new fourth end, to form the fuse-bonded joint by fusing members of the substrate web element to each other at locations spaced along the fourth width, the joint having an outer surface, and texture in the outer surface, along the second width of the substrate web, corresponding with the weave pattern.

36. A method as in claim 32, the joint describing an angle of at least 45 degrees with an axis extending parallel to the second length.

37. A method as in claim 32 and including reducing the prominence of the crown and the prominence of the valley such that paper made with the papermaking felt can be made to carry no mark, detectable by unaided visual observation, indicating the presence of the joint.

38. A method as in claim 32, including concurrently performing the severing and fuse bonding in steps (d) and (e) by applying ultrasonic energy to the first and second end portions at a corresponding severing locus.

39. A method as in claim 38, including applying the ultrasonic energy to the substrate web element by advancing the severing locus across the fourth width.

40. A papermaking felt made according to a method of claim 32.

41. A method of making a papermaking felt circumscribing a closed loop path, the papermaking felt comprising a closed loop substrate web, the papermaking felt having opposing first and second surfaces, and first and second batts of fibrous material assembled to the papermaking felt at the first and second surfaces, the papermaking felt having a first length along the closed loop path, and a first width extending transverse to the first length, the substrate web having a second length, and a second width transverse to the second width, and opposing third and fourth surfaces, the method comprising the steps of:

(a) fabricating a substrate web precursor, having a third length and a third width, and fifth and sixth opposing surfaces, by weaving threads extending along the third length and the third width;

(b) severing, from the substrate web precursor, a substrate web element having a fourth length, and a fourth width transverse to the fourth length, and first and second ends and corresponding first and second edges;

(c) superposing first and second end portions of the substrate web element adjacent the first and second ends, with the first and second ends generally aligned with each other and the first and second end portions extending away from the respective first and second ends in a common direction;

(d) fuse bonding the first and second end portions to each other at the first and second ends, to form a fuse-bonded joint at the first and second ends while the first and second end portions are so superposed with respect to each other, thus forming the substrate web element into the closed loop substrate web having a fuse-bonded joint extending across the substrate web; and (e) assembling fibrous batt material to at least one of the first and second surfaces.

42. A method as in claim 41, including the step, performed simultaneously with step (d), of cutting the substrate web element across the fourth width proximate the first and second ends, thus forming a new first end and a new second end adjacent the respective first and second ends, and thereby making a new cut in the substrate web element in each of the first and second end portions concurrent with fuse bonding the end portions to each other at the new first end and the new second end.

43. A method as in claim 41, the method comprising joining the first and second ends, to form the at least one transverse joint by fuse bonding members of the substrate web element to each other at locations spaced along the fourth width of the substrate web element, the joint having an outer surface, and texture in the outer surface, along the second width of the substrate web, corresponding with the weave pattern.

44. A method as in claim 41, the joint describing an angle of at least 45 degrees with an axis extending parallel to the fourth length.

45. A method as in claim 41, the method including severing the substrate web element through both of the first and second end portions across the fourth width proximate the first and second ends to form a new first end and a new second end, and fuse bonding the new first end and the new second end to each other to form the fuse-bonded join, and correspondingly the substrate web, while the first and second end portions are so superposed with respect to each other, rotating the first and second end portions about the fuse bonded joint such that the first and second end portions extend generally away from each other, with the joint forming a crown on the third surface and a valley on the fourth surface.

46. A method as in claim 45 and including reducing the prominence of the crown and the prominence of the valley such that paper made with the papermaking felt can be made to carry no mark, detectable by unaided visual observation, indicating the presence of the joint.

47. A method as in claim 41, including severing surplus material from the first and second end portions to thereby form a new first end and a new second end, and concurrently performing the fuse bonding of step (d) on the new first end and the new second end.

48. A method as in claim 41, the method including rotating the first and second end portions about the fuse-bonded joint such that the first and second end portions extend away from each other, with the joint forming a crown on the third surface and a valley on the fourth surface, and subsequently needling a batt of fibrous material to at least one of the third and fourth surfaces.

49. A method as in claim 41, including concurrently severing and fuse bonding the substrate web element at the first and second end portions by applying ultrasonic energy to the first and second end portions at a corresponding severing locus.

50. A method as in claim 49, the method including applying the ultrasonic energy to the substrate web element by advancing an ultrasonic device across the fourth width.

51. A method as in claim 41, the fuse-bonded joint extending across the entirety of the substrate web, from the first edge to the second edge.

52. A papermaking felt made according to a method of claim 41.

53. A papermaking felt made according to a method of claim 42.

54. A papermaking felt made according to a method of claim 45.

55. A papermaking felt made according to a method of claim 46.

56. A papermaking felt made according to a method of claim 47.

57. A papermaking felt made according to a method of claim 48.

58. A papermaking felt made according to a method of claim 50.

59. A method of making a papermaking felt circumscribing a closed loop path, the papermaking felt comprising a closed loop substrate web, the papermaking felt having opposing first and second surfaces, and first and second batts of fibrous material assembled to the papermaking felt at the first and second surfaces, the papermaking felt having a first length along the closed loop path, and a first width transverse to the first length, the substrate web having a second length, and a second width transverse to the second width, and opposing third and fourth surfaces, the method comprising the steps of:

(a) fabricating first and second flat-woven substrate web precursors having first and second sets of properties, differing from each other, the first substrate web precursor having a third length, and a third width transverse to the third length, and a first weave pattern, the second substrate web precursor having a fourth length, and a fourth width transverse to the fourth length, and a second weave pattern;

(b) subsequent to fabricating the first and second flat-woven substrate web precursors in step (a), specifying properties of the papermaking felt to be made;

(c) selecting, according to the properties specified in step (b), a preferred one of the first and second flat-woven substrate web precursors, for making the papermaking felt;

(d) severing a substrate web element from the selected one of the first and second flat-woven substrate web precursors to appropriate fifth length and fifth width according to the properties specified in step (b), whereby the substrate web element so made has first and second edges extending along the fifth length, corresponding first and second ends extending across the fifth width, and fifth and sixth opposing surfaces;

(e) superposing first and second end portions of the substrate web element adjacent the first and second ends, with the first and second ends generally aligned with each other and the first and second end portions extending away from the respective first and second ends in a common direction;

(f) fuse bonding the first and second ends to each other to form a fuse-bonded joint while the first and second end portions are so superposed with respect to each other, thus forming the substrate web element into the closed loop substrate web having the second length and the second width, and the opposing third and fourth surfaces, and a fuse-bonded joint extending across the substrate web between the first and second edges; and (g) assembling a batt of fibrous material to at least one of the third and fourth surfaces.

60. A method as in claim 59, including the step, performed simultaneously with step (f), of cutting the substrate web element across the fourth width proximate the first and second ends, thus forming a new first end and a new second end adjacent the respective first and second ends, and thereby making a new cut in the substrate web element in each of the first and second end portions concurrent with fuse bonding the end portions to each other at the new first end and the new second end.

61. A method as in claim 59, the method comprising joining the first and second ends, to form the joint by fuse bonding members of the substrate web element to each other at locations spaced along the fifth width of the substrate web element, the joint having an outer surface, and texture in the outer surface, along the second width, corresponding to the weave pattern of the selected one of the first and second flat-woven substrate web precursors.

62. A method as in claim 59, the joint describing an angle of at least 45 degrees with an axis extending parallel to the second length.

63. A method as in claim 59, the method including severing the substrate web element through both of the first and second end portions across the fifth width proximate the first and second ends to form a new first end and a new second end, and fuse bonding the new first end and the new second end to each other to form the fuse-bonded joint, and correspondingly the substrate web, while the first and second end portions are so superposed with respect to each other, rotating the first and second end portions about the fuse-bonded joint such that the first and second end portions extend generally away from each other, with the joint forming a crown on the third surface and a valley on the fourth surface.

64. A method as in claim 59 and including reducing the prominence of the crown and the prominence of the valley such that paper made with the papermaking felt can be made to carry no mark, detectable by unaided visual observation, indicating the presence of the joint.

65. A method as in claim 59, including severing surplus material from the first and second end portions to thereby form a new first end and a new second end, and concurrently performing the fuse bonding of step (f) on the new first end and the new second end.

66. A method as in claim 59, the method including rotating the first and second end portions about the fuse-bonded joint such that the first and second end portions extend away from each other, with the joint forming a crown on the third surface and a valley on the fourth surface, and subsequently needling a batt of fibrous material to at least one of the third and fourth surfaces.

67. A papermaking felt made according to a method of claim 59.

68. A papermaking felt made according to a method of claim 60.

69. A papermaking felt made according to a method of claim 63.

70. A papermaking felt made according to a method of claim 64.

71. A papermaking felt made according to a method of claim 65.

72. A papermaking felt made according to a method of claim 66.

73. A method of making a papermaking felt, the papermaking felt circumscribing a closed loop path, the papermaking felt comprising a substrate web, the papermaking felt having opposing first and second surfaces, and first and second batts of fibrous material assembled to the first and second surfaces, the papermaking felt having a first length along the closed loop path and a first width extending transverse to the length, the substrate web having opposing third and fourth surfaces, a second length, and a second width transverse to the second length, the method comprising the steps of:

(a) fabricating a flat-weave substrate web precursor on a shuttle-less loom, the flat-weave substrate web precursor having a third length, and a third width transverse to the third length;

(b) severing, from the flat-weave substrate web precursor, a substrate web element having a fourth length, a fourth width transverse to the fourth length, and first and second edges extending along the fourth length;

(c) forming the substrate web element into a closed loop path, and thereby fabricating the substrate web, by fuse-bonding first and second ends of the substrate web element to form a fuse-bonded joint; and (d) securing a batt of fibrous material to at least one of the third and fourth surfaces.

74. A method of making paper on a continuous-process paper machine, the paper machine including a forming fabric circumscribing a first closed loop path and a papermaking felt circumscribing a second closed loop path, the papermaking felt having a first surface for receiving thereon a web of paper being formed on the paper machine, and an opposing second surface remote from the first surface, the method comprising employing, as the continuous loop felt, a felt having a first length, a first width, and comprising a substrate web and first and second batts of fibrous material assembled to opposing third and fourth surfaces of the substrate web, the third and fourth surfaces of the substrate web generally corresponding to the first and second surfaces of the felt, the substrate web comprising at least one substrate web element having fifth and sixth opposing surfaces and extending about the second closed loop path, the at least one substrate web element comprising a joint extending across the first width, the joint having a crown on the fifth surface and a corresponding valley on the sixth surface, the method including orienting the papermaking felt with respect to the paper machine such that the crown is displaced from the first surface.

75. A method as in claim 74 including the step of orienting the papermaking felt with respect to the paper machine such that the fifth surface, and thus the crown, is directed away from the first surface.

* * * * *